US011575991B2

(12) United States Patent
Badger et al.

(10) Patent No.: US 11,575,991 B2
(45) Date of Patent: Feb. 7, 2023

(54) STEREOPHONIC LOUDSPEAKER SYSTEM AND METHOD OF USE THEREOF

(71) Applicant: Clean Energy Labs, LLC, Austin, TX (US)

(72) Inventors: David A. Badger, Lago Vista, TX (US); Joseph F. Pinkerton, Austin, TX (US)

(73) Assignee: Clean Energy Labs, LLC, Austin, TX (US)

( * ) Notice: Subject to any disclaimer, the term of this patent is extended or adjusted under 35 U.S.C. 154(b) by 0 days.

(21) Appl. No.: 17/282,957

(22) PCT Filed: Oct. 24, 2019

(86) PCT No.: PCT/US2019/057871
§ 371 (c)(1),
(2) Date: Apr. 5, 2021

(87) PCT Pub. No.: WO2020/086852
PCT Pub. Date: Apr. 30, 2020

(65) Prior Publication Data

US 2021/0385577 A1 Dec. 9, 2021

Related U.S. Application Data

(60) Provisional application No. 62/749,938, filed on Oct. 24, 2018.

(51) Int. Cl.
*H04R 5/02* (2006.01)
*H04R 1/24* (2006.01)
(Continued)

(52) U.S. Cl.
CPC ..... *H04R 5/02* (2013.01); *H04R 1/24* (2013.01); *H04R 3/14* (2013.01); *H04R 19/02* (2013.01)

(58) Field of Classification Search
CPC ... H04R 5/02; H04R 1/24; H04R 3/14; H04R 19/02; H04R 7/04
See application file for complete search history.

(56) References Cited

U.S. PATENT DOCUMENTS 3,931,469 A * 1/1976 Elliott ..... H04R 19/02 381/191
8,139,762 B2 * 3/2012 Kuroda ..... H04R 1/02 379/433.02

(Continued)

FOREIGN PATENT DOCUMENTS

GB 2045028 A * 10/1980 ..... H04R 19/02
JP 2008022495 A * 1/2008 ..... H04R 1/323

*Primary Examiner* — Oyesola C Ojo
(74) *Attorney, Agent, or Firm* — Dickinson Wright PLLC; Ross Spencer Garsson

(57) ABSTRACT

An improved loudspeaker system that produces an improved audio quality for stereophonic sound, which can be described as 3D audio. In one embodiment, the improved loudspeaker utilizes at least three stacks of electrostatic transducer cards, with one of the stacks located between the other two stacks. While there is generally some crossover between the frequencies of the stacks of electrostatic transducers, the middle stack will be directed to the lower frequency ranges and the other two stacks will be directed to the higher frequency ranges. Each of the three card stacks will utilize multi-track audio recordings, such as two-track audio recordings, which are modified for each of the three card stacks. In an alternative embodiment, the improved loudspeaker can utilize a conventional voice-coil driver in lieu of the middle stack of electrostatic transducer cards.

29 Claims, 20 Drawing Sheets

(51) Int. Cl.
*H04R 3/14* (2006.01)
*H04R 19/02* (2006.01)

(56) References Cited

U.S. PATENT DOCUMENTS

| | | | | |
|---|---|---|---|---|
| 9,197,963 | B1 * | 11/2015 | North | H04S 5/00 |
| 9,596,544 | B1 * | 3/2017 | Brotherton | H04R 19/02 |
| 2007/0189559 | A1 * | 8/2007 | Haan | H04R 19/02 381/116 |
| 2010/0303264 | A1 * | 12/2010 | Fletcher | H04R 5/02 381/300 |
| 2015/0010176 | A1 * | 1/2015 | Schevciw | F21S 8/02 381/190 |
| 2015/0208174 | A1 * | 7/2015 | Pinkerton | B06B 1/0269 381/165 |
| 2016/0234603 | A1 * | 8/2016 | Pinkerton | H04R 3/12 |

* cited by examiner

STEREOPHONIC LOUDSPEAKER SYSTEM AND METHOD OF USE THEREOF

RELATED PATENT APPLICATIONS

This application is a 35 U.S.C § 371 national application of PCT Application No. PCT/US19/57871, filed on Oct. 24, 2019, entitled "Stereophonic Loudspeaker System And Method Of Use Thereof," claiming priority to U.S. Provisional Patent Ser. No. 62/749,938, filed on Oct. 24, 2018, to Joseph F. Pinkerton et al., entitled "Stereophonic Loudspeaker System And Method Of Use Thereof."

This application is related to International Patent Application No. PCT/US19/47325, filed on Aug. 20, 2019, to Joseph F. Pinkerton et al., entitled "Compact Electroacoustic Transducer And Loudspeaker System And Method Of Use Thereof" (the "Pinkerton PCT '325 application").

This application is related to U.S. patent application Ser. No. 16/510,669, filed on Jul. 12, 2019, and is entitled "Compact Electroacoustic Transducer and Loudspeaker System and Method Of Use Thereof" (the "Pinkerton '669 application").

This application is related to U.S. patent application Ser. No. 16/510,702, filed on Jul. 12, 2019, and is entitled "Cover-Baffle-Stand System For Loudspeaker System And Method Of Use Thereof" (the "Pinkerton '702 application").

This application is related to U.S. Pat. No. 10,250,997, entitled "Compact Electroacoustic Transducer and Loudspeaker System and Method Of Use Thereof," which issued Apr. 2, 2019, to Pinkerton et al. (the "Pinkerton '997 patent") from U.S. patent application Ser. No. 15/333,488, filed on Oct. 25, 2016.

This application is also related to U.S. Pat. No. 9,167,353, entitled "Electrically Conductive Membrane Pump/Transducer And Methods To Make And Use Same," which issued Oct. 20, 2015, to Pinkerton et al. (the "Pinkerton '353 patent") from U.S. patent application Ser. No. 14/309,615, filed on Jun. 19, 2014, which is a continuation-in-part to U.S. patent application Ser. No. 14/161,550, filed Jan. 22, 2014.

This application is also related to U.S. Pat. No. 9,143,868, entitled "Electrically Conductive Membrane Pump/Transducer And Methods To Make And Use Same," which issued Sep. 22, 2015 to Pinkerton et al. (the "Pinkerton '868 patent") from U.S. patent application Ser. No. 14/047,813, filed Oct. 7, 2013, which is a continuation-in-part of International Patent Application No. PCT/2012/058247, filed Oct. 1, 2012, which designated the United States and claimed priority to provisional U.S. Patent Application Ser. No. 61/541,779, filed Sep. 30, 2011.

This application is also related to U.S. Pat. No. 9,924,275, entitled "Loudspeaker Having Electrically Conductive Membrane Transducers," which issued Mar. 30, 2018 to Pinkerton et al. (the "Pinkerton '275 patent") from U.S. patent application Ser. No. 15/017,452, filed Feb. 5, 2016, which claimed priority to provisional U.S. Patent Application Ser. No. 62/113,235, filed Feb. 6, 2015.

This application is also related to U.S. Pat. No. 9,826,313, entitled "Compact Electroacoustic Transducer And Loudspeaker System And Method Of Use Thereof," which issued Nov. 21, 2017, to Pinkerton et al., (the "Pinkerton '313 patent") from U.S. patent application Ser. No. 14/717,715, filed May 20, 2015.

U.S. patent application Ser. No. 15/647,073, filed Jul. 11, 2017, to Joseph F. Pinkerton et al., and entitled "Electrostatic Membrane Pump/Transducer System And Methods To Make And Use Same," (the "Pinkerton '073 application").

This application is also related to International Patent Application No. PCT/US19/30438, filed May 2, 2019, entitled "Loudspeaker System and Method Of Use Therefor," to Pinkerton et al. (the "Pinkerton PCT '438 application"). which designated the United States and claimed priority to provisional U.S. Patent Application Ser. No. 62/666,002, filed May 2, 2018

This application is also related to International Patent Application No. PCT/US19/33088, filed May 20, 2019, entitled "Compact Electroacoustic Transducer And Loudspeaker System And Method Of Use Thereof," to Badger, Pinkerton, and Everett (the "Badger PCT '088 application"), which designated the United States and claimed priority to provisional U.S. Patent Application Ser. No. 62/673,620, filed May 18, 2018.

All of these above-identified patent applications are commonly assigned to the Assignee of the present invention and are hereby incorporated herein by reference in their entirety for all purposes.

TECHNICAL FIELD

The present invention relates to loudspeaker systems, and in particular, to stereophonic loudspeakers systems having an array of electrostatic transducers. The electrically conductive transducers generate the desired sound by the use of pressurized airflow.

BACKGROUND

Stereophonic sound or, more commonly, stereo, is a method of sound reproduction that creates an illusion of multi-directional audible perspective. This is usually achieved by using two or more independent audio channels through a configuration of two or more loudspeakers (or stereo headphones) in such a way as to create the impression of sound heard from various directions, as in natural hearing. Thus the term "stereophonic" applies to so-called "quadraphonic" and "surround-sound" systems as well as the more common two-channel, two-speaker systems. It is often contrasted with monophonic, or "mono" sound, where audio is heard as coming from one position, often ahead in the sound field (analogous to a visual field). Stereo sound is common in entertainment systems such as broadcast radio, TV, recorded music, and cinema.

There are various techniques for recording the independent audio channels for stereophonic sound, including (a) the A-B technique (time-of-arrival stereophony), (b) the X-Y technique: intensity stereophony, M/S technique: mid-side stereophony, and near-coincident technique (mixed stereophony), and pseudo-stereo.

Stereophonic sound attempts to create an illusion of location for various sound sources (voices, instruments, etc.) within the original recording by utilizing the independent audio channel recordings. The recording engineer's goal is usually to create a stereo "image" with localization information. When a stereophonic recording is heard through loudspeaker systems (rather than headphones), each ear, of course, hears sound from both speakers. The audio engineer may, and often does, use more than two microphones (sometimes many more) and may mix them down to two (or more) tracks in ways that exaggerate the separation of the instruments, to compensate for the mixture that occurs when listening via speakers.

Descriptions of stereophonic sound tend to stress the ability to localize the position of each instrument in space, but this would only be true in a carefully engineered and installed system, where speaker placement and room acoustics are taken into account. In reality, many playback systems, such as all-in-one loudspeaker system units and the like, are incapable of recreating a realistic stereo image.

Originally, in the late 1950s and 1960s, stereophonic sound was marketed as seeming "richer" or "fuller-sounding" than monophonic sound, but these sorts of claims were and are highly subjective, and again, dependent on the equipment used to reproduce the sound. In fact, poorly recorded or reproduced stereophonic sound can sound far worse than well done monophonic sound. When playing back stereo recordings, the best results are obtained by using two identical speakers, in front of and equidistant from the listener, with the listener located on a center line between the two speakers. In effect, an equilateral triangle is formed, with the angle between the two speakers around 60 degrees as seen from the listener's point of view.

Accordingly, there continues to be a need for a speaker system for improved listening of stereophonic sound.

Graphene membranes (also otherwise referred to as "graphene drums") have been manufactured using a process such as disclosed in Lee et al. Science, 2008, 321, 385-388. PCT Patent Appl. No. PCT/US09/59266 (Pinkerton) (the "Pinkerton '266 PCT application") described tunneling current switch assemblies having graphene drums (with graphene drums generally having a diameter between about 500 nm and about 1500 nm). PCT Patent Appl. No. PCT/US11/55167 (Pinkerton et al.) and PCT Patent Appl. No. PCT/US11/66497 (Everett et al.) further describe switch assemblies having graphene drums. PCT Patent Appl. No. PCT/US11/23618 (Pinkerton) (the "PCT US11/23618 application") described a graphene-drum pump and engine system.

FIGS. 1-5 are figures that have been reproduced from FIGS. 27-32 of the Pinkerton '353 patent. As set forth in the Pinkerton '353 patent:

FIGS. 1A-1E depict an electrically conductive membrane pump/transducer 2700 that utilizes an array of electrically conductive membrane pumps that cause a membrane 2702 to move in phase. FIGS. 1A-1B are cross-sectional views of the pump/transducer that includes electrically conductive members 2701 (in the electrically conductive membrane pumps) and a speaker membrane 2702. Speaker membrane 2702 can be made of a polymer, such as PDMS. Each of the electrically conductive membrane pumps has a membrane 2701 that can deflect toward downward and upwards. Traces 2605 are a metal (like copper, tungsten, or gold). The electrically conductive membrane pumps also have a structural material 2703 (which can be plastic, FR4 (circuit board material), or Kapton® polyimide film (DuPont USA)) and support material 2704 that is an electrical insulator (like oxide, FR4, or Kapton® polyimide film). Support material 2704 can be used to support the pump membrane, support the stator and also serve as the vent structure. Integrating these functions into one element makes device 2700 more compact than it would be with multiple elements performing these functions. All of the non-membrane elements shown in FIG. 1A-1E can be made from printed circuit boards or die stamped sheets, which enhances manufacturability.

Arrows 2706 and 2707 show the direction of fluid flow (i.e., air flow) in the pump/transducer 2700. When the electrically conductive membranes 2701 are deflected downward (as shown in FIG. 1A), air will flow out of the pump/transducer device 2700 (from the electrically conductive membrane pumps) as shown by arrows 2706. Air will also flow from the cavity 2708 into the electrically conductive membrane pumps as shown by arrows 2707 resulting in speaker membrane 2702 moving downward. When the electrically conductive membranes 2701 are deflected upwards (as shown in FIG. 1B), air will flow into the pump/transducer device 2700 (into the electrically conductive membrane pumps) as shown by arrows 2706. Air will also flow into the cavity 2708 from the electrically conductive membrane pumps as shown by arrows 2707 resulting in speaker membrane 2702 moving upward.

FIG. 1C is an overhead view of pump/transducer device 2700. Line 2709 reflects the cross-section that is the viewpoint of cross-sectional views of FIGS. 1A-1B. FIGS. 1D-1E shows the flow of air (arrows 2707 and 2706, respectively) corresponding to the deflection downward of electrically conductive membranes 2701 and speaker membrane 2702 (which is shown in FIG. 1A). The direction of arrows 2707 and 2706 in FIGS. 1D-1E, respectively, are reversed when the deflection is upward (which is shown in FIG. 1B).

The basic operation for pump/transducer 2700 is as follows. A time-varying stator voltage causes the pump membranes 2701 to move and create pressure changes within the speaker chamber 2708. These pressure changes cause the speaker membrane 2702 to move in synch with the pump membranes 2701. This speaker membrane motion produces audible sound.

The ability to stack pumps in a compact way greatly increases the total audio power. Such a pump/transducer stacked system 2800 is shown in FIG. 2.

For the embodiments of the present invention shown in FIGS. 1A-1E and 2, the individual pump membranes 2701 can be smaller or larger than the speaker membrane 2702 and still obtain good performance.

Pump/transducer system 2700 (as well as pump/transducer speaker stacked system 2800) can operate at higher audio frequencies due to axial symmetry (symmetrical with respect to the speaker membrane 2702 center). Each membrane pump is approximately the same distance from the speaker membrane 2702 which minimizes the time delay between pump membrane motion and speaker membrane motion (due to the speed of sound) which in turn allows the pumps to operate at higher pumping/audio frequencies.

It also means that pressure waves from each membrane pump 2701 arrive at the speaker membrane 2702 at about the same time. Otherwise, an audio system could produce pressure waves that are out of synch (due to the difference in distance between each pump and the speaker membrane) and thus these waves can partially cancel (lowering audio power) at certain pumping/audio frequencies.

Pump/transducer system 2700 (as well as pump/transducer speaker stacked system 2800) further exhibit increased audio power. Since all the air enters/exits from the sides of the membrane pump, these pumps can be easily stacked (such as shown in FIG. 2) to significantly increase sound power. Increasing the number of pump stacks (also referred to "pump cards") from one to four (as shown in FIG. 2) increases audio power by approximately a factor of 16 As can be seen in FIG. 2, the gas within the chamber is sealed by the membrane pump membranes and the speaker membrane. The gas in the sealed chamber can be air or another gas such as sulfur hexafluoride that can withstand higher membrane pump voltages than air.

Audio output is approximately linear with electrical input (resulting in simpler/cheaper electronics/sensors). Another advantage of the design of pump/transducer 2700 is the way the pump membranes 2701 are charged relative to the gates/stators. These are referred to as "stators," since the term "gate" implies electrical switching. Pump/transducers have a low resistance membrane and the force between the stator and membrane is always attractive. This force also varies as the inverse square of the distance between the pump membrane and stator (and this characteristic can cause the audio output to be nonlinear/distorted with respect to the electrical input). The membrane can also go into "runaway" mode and crash into the stator. Thus, in practice, the amplitude of the membrane in pump/transducer is limited to less than half of its maximum travel (which lowers pumping speed and audio power).

The issues resulting from non-linear operation are solved in the design of pump/transducer 2700 by using a high resistance membrane (preferably a polymer film like Mylar with a small amount of metal vapor deposited on its surface) that is charged by a DC voltage and applying AC voltages to both stators (one stator has an AC voltage that is 180 degrees out of phase with the other stator). A high value resistor (on the order of $10^8$ ohms) may also be placed between the high resistance membrane (on the order of $10^6$ to $10^{12}$ ohms per square) and the source of DC voltage to make sure the charge on the membrane remains constant (with respect to audio frequencies).

Because the pump membrane 2701 has relatively high resistance (though low enough to allow it to be charged in several seconds) the electric field between one stator and the other can penetrate the charged membrane. The charges on the membrane interact with the electric field between stator traces to produce a force. Since the electric field from the stators does not vary as the membrane moves (for a given stator voltage) and the total charge on the membrane remains constant, the force on the membrane is constant (for a give stator voltage) at all membrane positions (thus eliminating the runaway condition and allowing the membrane to move within its full range of travel). The electrostatic force (which is approximately independent of pump membrane position) on the membrane increases linearly with the electric field of the stators (which in turn is proportional to the voltage applied to the stators) and as a result the pump membrane motion (and also the speaker membrane 2702 that is being driven by the pumping action of the pump membrane 2701) is linear with stator input voltage. This linear link between stator voltage and pump membrane motion (and thus speaker membrane motion) enables a music voltage signal to be routed directly into the stators to produce high quality (low distortion) music.

FIG. 3 depicts an electrically conductive membrane pump/transducer 3000 that is similar to the pump/transducers 2700 and 2900, in that it utilizes an array of electrically conductive membrane pumps. Pump/transducer 3000 does not utilize a speaker membrane (such as in pump/transducer 2700) or a structure in place of the speaker membrane (such as in pump/transducer 2900). Pump/transducer 3000 produces substantial sound even without a speaker membrane. Applicant believes the reason that there is still good sound power is that the membrane pumps are compressing the air as it makes its way out of the inner vents (increasing the pressure of an time-varying air stream increases its audio power). Arrows 3001 show the flow of air through the inner vents. The pump/transducer 3000 has a chamber that receives airflow 3001 and this airflow exhausts out the chamber by passing through the open area (the chamber exhaust area) at the top of the chamber. In order to produce substantial sound the total area of the membrane pumps must be at least 10 times larger than the chamber exhaust area.

FIG. 3 also shows an alternate vent configuration that has holes 3003 in the stators that allow air to flow to separate vent layers. The cross-sectional airflow area of the vents (through which the air flow is shown by arrows 3001) is much smaller than the pump membrane area (so that the air is compressed). FIG. 3 also shows how a simple housing 3004 can direct the desired sound 3005 toward the listener (up as shown in FIG. 3) and the undesired out of phase sound away from the listener (down as shown in FIG. 3). The desired sound 3005 is in the low sub-woofer range to mid-range (20 Hz to about 3000 Hz).

FIG. 4 depicts an electrically conductive membrane pump/transducer 3100 that is the pump/transducer 3000 that also includes an electrostatic speaker 3101 (which operates as a "tweeter"). An electrostatic speaker is a speaker design in which sound is generated by the force exerted on a membrane suspended in an electrostatic field. The desired sound 3102 from the electrostatic speakers 3101 is in a frequency in the range of around 2 to 20 KHz (generally considered to be the upper limit of human hearing). Accordingly, pump/transducer 3100 is a combination system that includes a low/mid-range speaker and a tweeter speaker.

FIG. 5 depicts an electrically conductive membrane pump/transducer 3200 that is the pump/transducer 3100 that further includes the speaker membrane 3202 (such as in pump/transducer 2700).

FIGS. 6A-6C and 7 are figures that have been reproduced from FIGS. 16A-16C and 17 of the Pinkerton '313 patent. As set forth in the Pinkerton '313 patent:

FIG. 6A illustrates an electroacoustic transducer 1601 ("ET," which can also be referred to as a "pump card") and its solid stator 1602 (shown in more detail in FIG. 6B). Vent fingers 1603 are also shown in ET 1601. FIG. 6B is a magnified view of ET 1601 and shows how there are membranes 1604 and 1605 on each side of shared stator 1602.

FIG. 6C shows the electroacoustic transducer 1601 having a single stator card before trimming off the temporary support 1606 that supports the vent fingers 1603 (as shown in FIGS. 6A-6B). This process enables a low cost die stamping construction. Parts can be stamped out (which is very low cost), then epoxied together, and then the part 1606 that temporarily holds all the vent fingers 1603 in place can be quickly stamped off or trimmed off.

FIG. 7 is an exploded view of ET 1601. From top to bottom: FIG. 7 shows an electrically conductive membrane 1604, a first metal frame 1701, first non-conductive vent member 1702 (with its 23 vent fingers 1703), solid metal stator 1602, second non-conductive vent member 1704, and second metal frame 1705. (The second membrane is not shown). These parts can be joined together with epoxy, double-sided tape, sheet adhesive or any other suitable bonding process. After membrane 1604 is bonded to frame 1701 its entire outside edge (peripheral edge) is supported by frame 1701.

FIGS. 8A-8B are figures that have been reproduced from FIGS. 8A-8B of the Badger '088 PCT application. As set forth in the Badger '088 PCT application:

FIG. 8A illustrates an exploded view of an electroacoustic transducer 801 that has two pump cards. This is similar to the electroacoustic transducer 1601 shown in FIG. 7. However, electroacoustic transducer 801 does not have metal frames 1701 and 1705. I.e., the double stack cards of electroacoustic transducer 801 lack any frames.

From top to bottom: FIGS. 8A-8B shows a first non-conductive vent member 802 (with its 23 vent fingers), a first electrically conductive membrane 803, a second non-conductive vent member 804, a first solid metal stator 805, a third non-conductive vent member 806, a second electrically conductive membrane 807, a fourth non-conductive vent member 808, and a second solid metal stator 809. As before, these parts can be joined together with epoxy, double-sided tape, sheet adhesive or any other suitable bonding process. FIG. 8B shows the electroacoustic transducer 801 after its parts (as shown in FIG. 8A) have been bonded together.

The membranes (membranes 803 and 807) are supported by the pair of non-conductive vent membranes above and below the membrane. For example, first non-conductive vent member 802 supports a portion of a first electrically conductive membrane 803 and second non-conductive vent member 804 supports the other portion of first electrically conductive membrane 803. No non-conductive vent by itself can support the electrically conductive membrane.

This absence of the frames from electroacoustic transducer 801 was significant and provided advantageous and unexpected results. The frames in the earlier pump cards (such as the electroacoustic transducer 1601 shown in FIG. 7) were expensive, difficult to make (the metal spans being both thin and narrow) and also had a tendency of causing electrical arcs to the stator. By removing the frames, the electrical arcing has been eliminated in electroacoustic transducer 801.

FIGS. 9A-9B are figures that has been reproduced from FIGS. 9A-9B of the Pinkerton '073 application. As set forth in the Pinkerton '073 application:

FIGS. 9A-9B show a speaker 900 that utilizes EVMP card stacked arrays 901-903. Each of the EVMP card stacked arrays has a face area, such as face area 909 of EVMP card stacked array 903. Each of EVMP card stacked array 901-903 has two face areas, on one side of speaker 900 (such as face area 909 for EVMP card stacked array 903) and the other side of the speaker 900 (which is hidden in the view of FIGS. 9A-9B). Air enters and exits the EVMP card stacked arrays through each of the EVMP card stacked array face areas (In fact air enters and exits the EVMPs in the EVMP card stacked arrays through each of the face areas of the EVMP cards).

By way of example, the EVMP card stacked array 901 can be a stacked array of 30 cards. Each card in the EVMP card stacked array can be about 1 mm thick so the EVMP card stacked array 901 stack of cards is about 30 mm thick. The face area of one EVMP card (in the EVMP card stacked array) is 1 mm times the stack width (for example 300 mm), which calculates to be 300 $mm^2$ per card for each face of the EVMP card (which means the combined area of the faces of an EVMP card in the EVMP card stacked array is 600 $mm^2$ per EVMP card). Thus, for an EVMP card stacked array having 30 cards, this calculates to be 18,000 $mm^2$ for the total face area of the EVMP card stacked array. I.e., the area of face area 909 would be 9,000 $mm^2$, as it is one of the two faces of EVMP card stacked array 903.

The membrane area of that same EVMP card is the depth of the card (for example 20 mm) times the card width (which, again, for example, is 300 mm). This calculates to be 6,000 $mm^2$ per EVMP card, which is 10 times larger than the face area of the EVMP card. Again, for a 30 card stacked array in an EVMP card stacked array, this calculates to a total membrane area of 180,000 $mm^2$. This means that total membrane area of the EVMP card stacked array (such as EVMP card stacked array 903) is around 10 times the total face area of the EVMP card stacked array. It is worthwhile to note that speaker 900 shows three EVMP card stacked arrays (namely EVMP card stacked arrays 901-903), which can be run at different electrical phases.

The speaker 900 also utilizes two (one for each of the two stereo channels) "conventional" electrostatic audio actuator card stacks 904-905 (conventional in that the membrane pumping frequency equals the produced audio frequency). I.e., conventional card stacks 904-905 are stacks of electrostatic tweeter cards. The speaker 900 also includes electronics and battery 906 with control buttons 907. Speaker 900 has three EVMP card stacked arrays 901-903, and although all of the cards within these EVMP card stack arrays are similar in structure, each EVMP card stack arrays can be driven at a different electrical phase. For instance, the EVMPs in each of EVMP card stacked arrays 901-903 can have an electrical drive voltage phase of 0°, 120°, and 240°, respectively. I.e., the EVMPs in EVMP card stacked array 901 can be operated at 0°, the EVMPs in EVMP card stacked array 902 can be operated at 120°, and the EVMPs in EVMP card stacked array 903 can be operated at 240°.

FIGS. 10 and 11A-11B are figures that has been reproduced from FIGS. 4 and 5A-5B of the Pinkerton PCT '438 Application. As set forth in the PCT '438 Application:

FIG. 10 is an illustration of a dipole speaker 400 that has all electrostatic transducers. Sound comes out from side 401 and oppositely phased sound comes out the other side (not shown). It also has control buttons 407 and MEMs microphone ports 408 (with the MEMs microphones located behind microphone ports 408). The MEMs microphones are for example Knowles SPK0412HM4H-B-7 (Knowles Electronics, LLC, Itasca, Ill.) and are operably connected to a power source and a CPU on the speaker 400. The power source is generally the same power source as used for the speaker and the CPU controls the electrostatic transducers.

The MEMs microphone ports 408 on the speaker 400 have been positioned along the null sound plane (NSP) of the speaker 400 (which null sound plane 503 shown in FIG. 5B).

FIG. 11A is a top view of speaker 400, showing only the top. Opposite sides 401 and 501 are shown. Sound emits from side 401 and oppositely phased sound out side 501 in speaker 400 (which makes it a dipole speaker).

FIG. 11B is a magnified view of box 502 shown in FIG. 5A. The null sound plane 503 for speaker 400 is shown. The MEMs microphone ports are positioned along this null sound plane 503.

SUMMARY OF THE INVENTION

The present invention relates to an improved loudspeaker system that produces an improved audio quality for stereophonic sound, which can be described as 3D audio. As noted above, the prior art already produces audio recordings having independent audio-track recordings (also referred to as audio channel recordings), such as, typically, a two-audio track recording. Indeed, most commercially recorded music is two (or more) audio track recordings. While the present application will address systems that utilize a recording that has two-audio track recordings, a person of ordinary skill in the art will readily understand how the present invention can be adapted for use for recordings having multi-audio track recordings greater than two.

The improved loudspeaker utilizes at least three stacks of electrostatic transducer cards, with one of the stacks located between the other two stacks. The electrostatic transducers utilized in the loudspeakers include those disclosed and taught in the Pinkerton PCT '325 application, the Pinkerton '669 application, the Pinkerton '702 application, the Pinkerton '997 patent, the Pinkerton '353 patent, the Pinkerton '868 patent, the Pinkerton '275 patent, the Pinkerton '313 patent, the Pinkerton '073 application, the Pinkerton PCT '438 application, and the Badger PCT '088 application (collectively the "Pinkerton Patents and Applications").

While there is generally some crossover between the frequencies of the stacks of electrostatic transducers, the middle stack will be directed to the lower frequency ranges and the other two stacks will be directed to the higher frequency ranges. Moreover the middle stack will be a combination of the two-audio track recordings (generally averaged with one other). As for the first of the two other stacks (which is on one side of the middle stack), this first opposing stack will be directed to the first of the two audio-track recordings (with generally some increase in intensity) additionally modified by some elimination (subtraction) of the second of the two audio-track recordings. As for the second of the two other stacks (which is on the opposing side of the middle stack), this will be directed in the mirror way (i.e., the second of the two audio-track recordings (with generally some increase in intensity) additionally modified by some elimination (subtraction) of the first of the two audio-track recordings.

While the increase in intensity of one audio channel, and some elimination (subtraction) of the other audio channel can be independently controlled, in some embodiments of the present invention, these can be controlled together.

Surprisingly, by this arrangement, the at least three stacks of electrostatic transducer cards produce improved audio quality.

In general, in one aspect, the invention features a loudspeaker system that includes a middle speaker operable for emitting audible sound in a first range between 20 Hz and an upper set point frequency. The loudspeaker system further includes a first end speaker including a plurality of a first stack of cards having electrostatic transducers. The first end speaker is attached at or near a first end of the middle speaker. The first end speaker is operable for emitting audible sound in a second range between a lower set point frequency and 20 kHz. The loudspeaker system further includes a second end speaker including a plurality of a second stack of cards having electrostatic transducers. The second end speaker is attached at or near a second end of the middle speaker such that the middle speaker is between the first speaker and the second speaker. The second end speaker is operable for emitting audible sound in the second range between the lower set point frequency and 20 kHz. The loudspeaker system is operable to emit sound based upon an audio track recording comprising a first track ($T_1$) and a second track ($T_2$). The middle speaker is operable to emit sound based upon a weighted average of the first track ($T_1$) and the second track ($T_2$). The first end speaker is operable to emit sound based upon the first track ($T_1$) modified by at least some subtraction of the second track ($T_2$). The second end speaker is operable to emit sound based upon the second track ($T_2$) modified by at least some subtraction of the first track ($T_1$).

Implementations of the invention can include one or more of the following features:

The upper set point frequency can be at most 1000 Hz. The lower set point frequency can be at least 200 Hz.

The first stack of cards can have a stack card width that is the same as the second stack of cards.

The middle speaker can include a plurality of a third stack of cards having electrostatic transducers.

The third stack of cards can have a stack card width that is broader than (a) the stack card width of the first stack of cards and (b) the stack card width of the second stack of cards.

The stack card width of the first stack of cards can be 12 mm. The stack card width of the second stack of cards can be 12 mm. The stack card width of the third stack of cards can be 21 mm.

The first stack of cards can be parallel to the second stack of cards are parallel. The third stack of cards can be perpendicular to each of the first stack of cards and the second stack of cards.

The first stack of cards, the second stack of cards, and the third stack of cards can be parallel to one another.

The loudspeaker system can further include a first transformer to power the first stack of cards in the first end speaker. The loudspeaker system can further include a second transformer to power the second stack of cards in the second end speaker.

The loudspeaker system can further include a motherboard having a voltage inverter. The voltage inverter can have a first channel through which power can be routed through the first transformer to power the first stack of cards. The voltage inverter can have a second channel through which power can be routed through the second transformer to power the second stack of cards.

The loudspeaker system can have a changeover set point frequency.

The changeover set point frequency can be 300 Hz.

The upper set point frequency can be the changeover set point frequency. The lower set point frequency can be the changeover set point frequency.

The upper set point frequency can be greater than the changeover set point frequency. The lower set point frequency can be less than the changeover set point frequency.

The middle speaker can be operable for emitting audible sound at a decreasing volume percentage between the changeover set point frequency and the upper set point frequency, in which, at the changeover set point frequency, the volume percentage is 100% and, at the upper set point frequency, the volume percentage is 0%. The first end speaker and the second end speaker can each be operable for emitting audible sound at an increasing volume percentage between the lower set point frequency and the changeover set point frequency, in which, at the lower set point frequency, the volume percentage is 0% and, at the changeover set point frequency, the volume percentage is 100%.

The decreasing volume percentage between the changeover set point frequency and the upper set point frequency can be a linear decrease. The increasing volume percentage between the lower set point frequency and the changeover set point frequency can be a linear increase.

The weighted average of the first track ($T_1$) and the second track ($T_2$) for the middle speaker can be an average of the first track ($T_1$) and the second track ($T_2$) having the first formula $(T_1+T_2)/2$.

The first end speaker can be operable to emit sound based upon the first track ($T_1$) modified by at least some subtraction of the second track ($T_2$) utilizing the second formula $(1+x)T_1-(y)T_2$. The second end speaker can be operable to emit sound based upon the second track ($T_2$) modified by at least some subtraction of the first track ($T_1$) utilizing the third formula $(1+x)T_2-(y)T_1$. Each of x and y can be in a range between 0 and 1.5 for the second formula and the third formula.

Each of x and y can be in a range between 0.25 and 1.25 for the second formula and the third formula.

Each of x and y can be in a range between 0.5 and 1 for the second formula and the third formula.

Each of x and y can be 0.75 for the second formula and the third formula.

The loudspeaker system can be operable to vary x and y independently.

The loudspeaker system can further include a controller that is operable to vary x and y independently.

In the loudspeaker system, x and y can be dependent upon one another.

In the loudspeaker system, x can be equal to y, such that (a) the first formula is $T_1+x(T_1-T_2)$, and (b) the second formula is $T_2+x(T_2-T_1)$.

The loudspeaker system can further include a controller that is operable to vary x.

The controller can be a hand held controller.

The loudspeaker system can have a null sound plane.

In general, in another aspect, the invention features a method that includes selecting an audio track recording that includes a first track ($T_1$) and a second track ($T_2$). The method further includes utilizing a loudspeaker system to emit audible sound based upon the audio track recording. Utilizing the loudspeaker systems includes a middle speaker of the loudspeaker system is utilized to emit audible sound (I) in a first range between 20 Hz and an upper set point frequency and (II) based upon a weighted average of the first track ($T_1$) and the second track ($T_2$). Utilizing the loudspeaker systems further includes, a first end speaker of the loudspeaker system is utilized to emit audible sound (I) in a second range between a lower set point frequency and 20 kHz, and (II) based upon the first track ($T_1$) modified by at least some subtraction of the second track ($T_2$). The first end speaker includes a plurality of a first stack of cards having electrostatic transducers. The first end speaker is attached at or near a first end of the middle speaker. Utilizing the loudspeaker systems includes, a second end speaker of the loudspeaker system is utilized to emit audible sound (I) in the second range between the lower set point frequency and 20 kHz, and (II) based upon the second track ($T_2$) modified by at least some subtraction of the first track ($T_1$). The second end speaker includes a plurality of a second stack of cards having electrostatic transducers. The second end speaker is attached at or near a second end of the middle speaker such that the middle speaker is between the first speaker and the second speaker.

Implementations of the invention can include one or more of the following features:

The upper set point frequency can be at most 1000 Hz. The lower set point frequency can be at least 200 Hz.

The first stack of cards can have a stack card width that is the same as the second stack of cards.

The middle speaker can include a plurality of a third stack of cards having electrostatic transducers.

The third stack of cards can have a stack card width that is broader than (a) the stack card width of the first stack of cards and (b) the stack card width of the second stack of cards.

The stack card width of the first stack of cards can be 12 mm. The stack card width of the second stack of cards can be 12 mm. The stack card width of the third stack of cards can be 21 mm.

The first stack of cards can be parallel to the second stack of cards. The third stack of cards can be perpendicular to each of the first stack of cards and the second stack of cards.

The first stack of cards, the second stack of cards, and the third stack of cards can be parallel to one another.

The method can further include utilizing a first transformer to power the first stack of cards in the first end speaker. The method can further include utilizing a second transformer to power the second stack of cards in the second end speaker.

The loudspeaker system can further include a motherboard having a voltage inverter. The method can further include utilizing a first channel of the voltage inverter to route power through the first transformer to the first stack of cards. The method can further include utilizing a second channel of the voltage inverter to route power through the second transformer to the second stack of cards.

The loudspeaker system can have a changeover set point frequency.

The changeover set point frequency can be 300 Hz.

The upper set point frequency can be the changeover set point frequency. The lower set point frequency can be the changeover set point frequency.

The upper set point frequency can be greater than the changeover set point frequency. The lower set point frequency can be less than the changeover set point frequency.

The middle speaker can be utilized to emit audible sound at a decreasing volume percentage between the changeover set point frequency and the upper set point frequency, in which, at the changeover set point frequency, the volume percentage is 100% and, at the upper set point frequency, the volume percentage is 0%. Each of the first end speaker and the second end speaker can be utilized to emit audible sound at an increasing volume percentage between the lower set point frequency and the changeover set point frequency, in which, at the lower set point frequency, the volume percentage is 0% and, at the changeover set point frequency, the volume percentage is 100%.

The decreasing volume percentage between the changeover set point frequency and the upper set point frequency can be a linear decrease. The increasing volume percentage between the lower set point frequency and the changeover set point frequency can be a linear increase.

The weighted average of the first track ($T_1$) and the second track ($T_2$) for the middle speaker can be an average of the first track ($T_1$) and the second track ($T_2$) having the first formula $(T_1+T_2)/2$.

The first end speaker can be utilized to emit sound based upon the first track ($T_1$) modified by at least some subtraction of the second track ($T_2$) utilizing the second formula $(1+x)T_1-(y)T_2$. The second end speaker can be utilized to emit sound based upon the second track ($T_2$) modified by at least some subtraction of the first track ($T_1$) utilizing the third formula $(1+x)T_2-(y)T_1$. Each of x and y can be in a range between 0 and 1.5 for the second formula and the third formula.

Each of x and y can be in a range between 0.25 and 1.25 for the second formula and the third formula.

Each of x and y can be in a range between 0.5 and 1 for the second formula and the third formula.

Each of x and y can be 0.75 for the second formula and the third formula.

The method can further include varying x and y independently.

The method can further include utilizing a controller to vary x and y independently.

In the method, x and y can be dependent upon one another.

In the method, x can be equal to y, such that (a) the first formula is $T_1+x(T_1-T_2)$, and (b) the second formula is $T_2+x(T_2-T_1)$.

The method can further include utilizing a controller to vary x.

The controller can be a hand held controller.

The loudspeaker system can have a null sound plane.

DESCRIPTION OF DRAWINGS

FIGS. 1A-1B depict cross-section views of the pump/transducer. FIGS. 1C-1E depict overhead views of the pump/transducer.

DETAILED DESCRIPTION

The Pinkerton Patents and Applications disclose and teach loudspeakers in which the loudspeaker has a plurality of stacks of cards having electrostatic transducers, in which one stack of cards has a different width as another stack of cards in the plurality of stacks. At frequencies above a 200 Hz, and at the same drive voltage and current, the stack of lesser width produced significantly greater microphone voltage as compared to the stack of greater width cards. By combining the plurality of stacks of cards with different widths, this provides for the elimination of conventional cone drivers, and provides for improved sound both above and below 200 Hz using only electrostatic transducers. It also assists in maintaining a null sound plane that is beneficial for voice recognition.

Figure 1A:
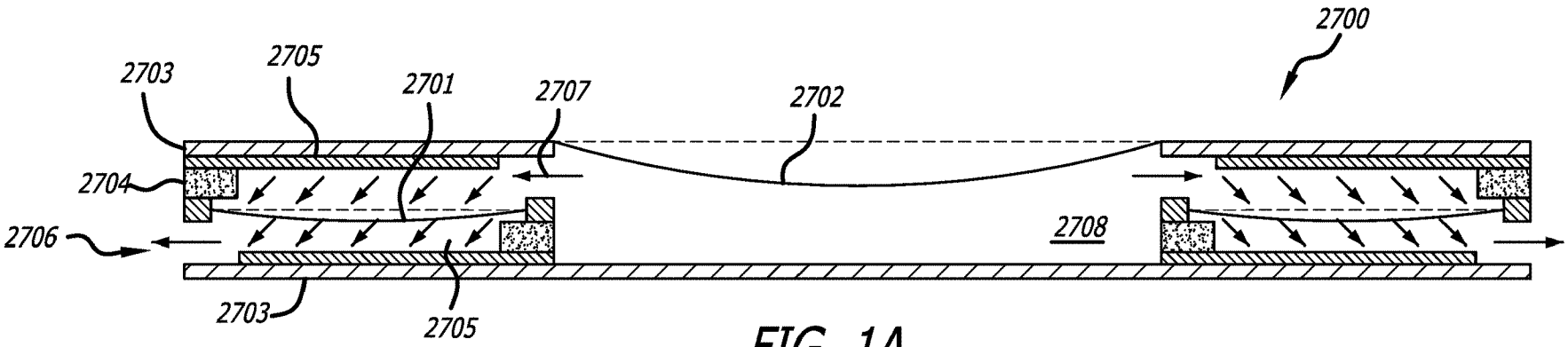
FIGS. 1A-1E (which are reproduced from the Pinkerton '353 patent) depict an electrically conductive membrane pump/transducer that utilizes an array of electrically conductive membrane pumps that cause a membrane to move in phase.
Figure 1B:
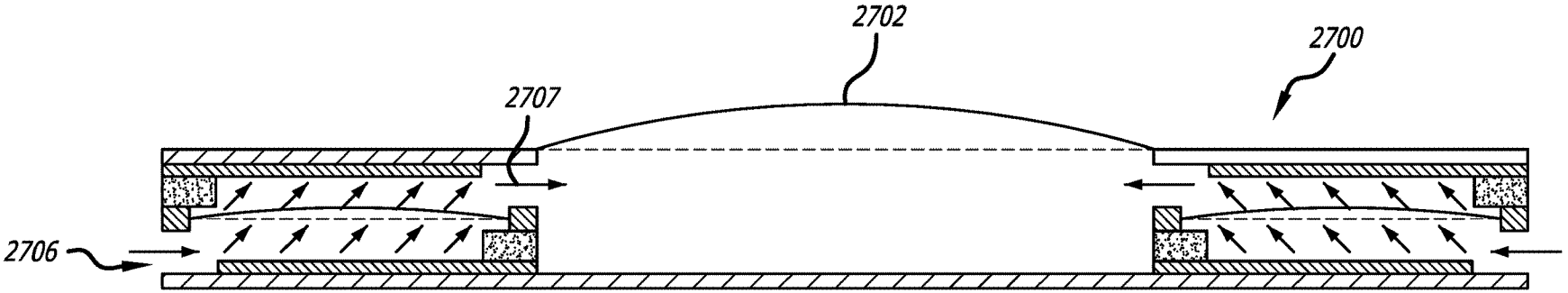
Figure 1C:
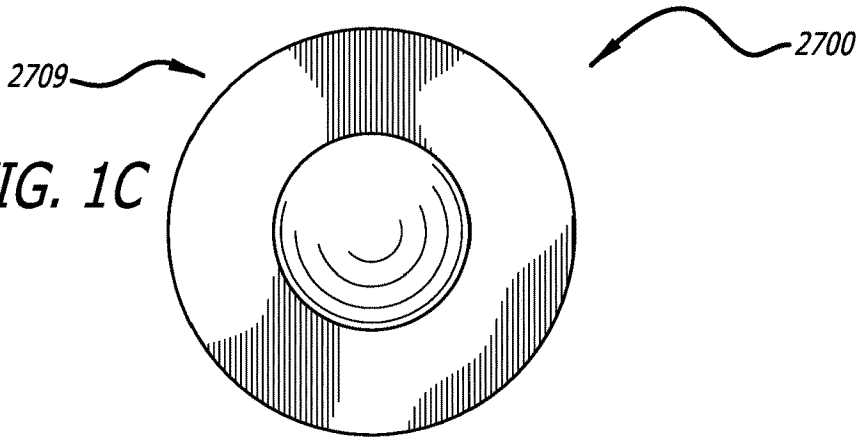
Figure 1D:
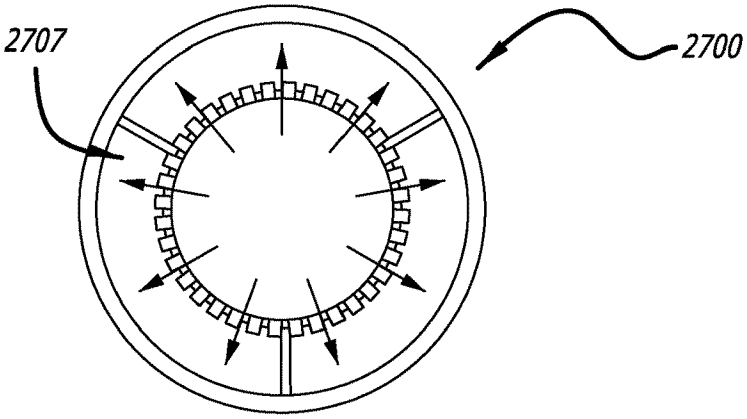
Figure 1E:
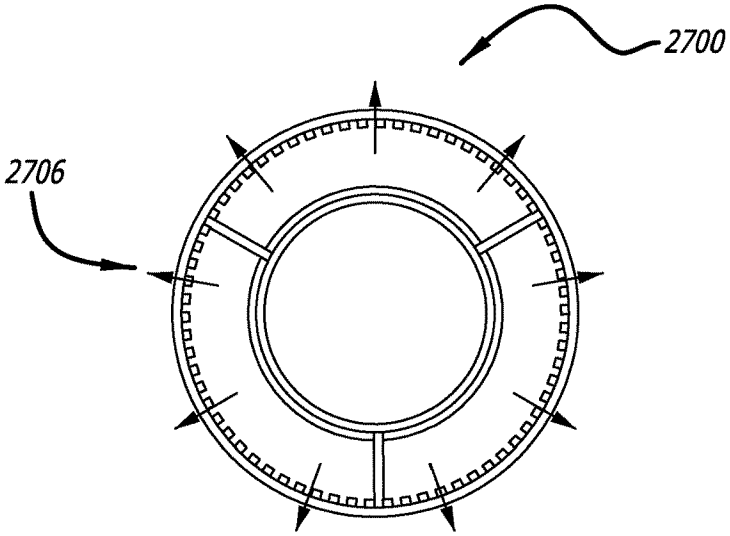
Figure 2:
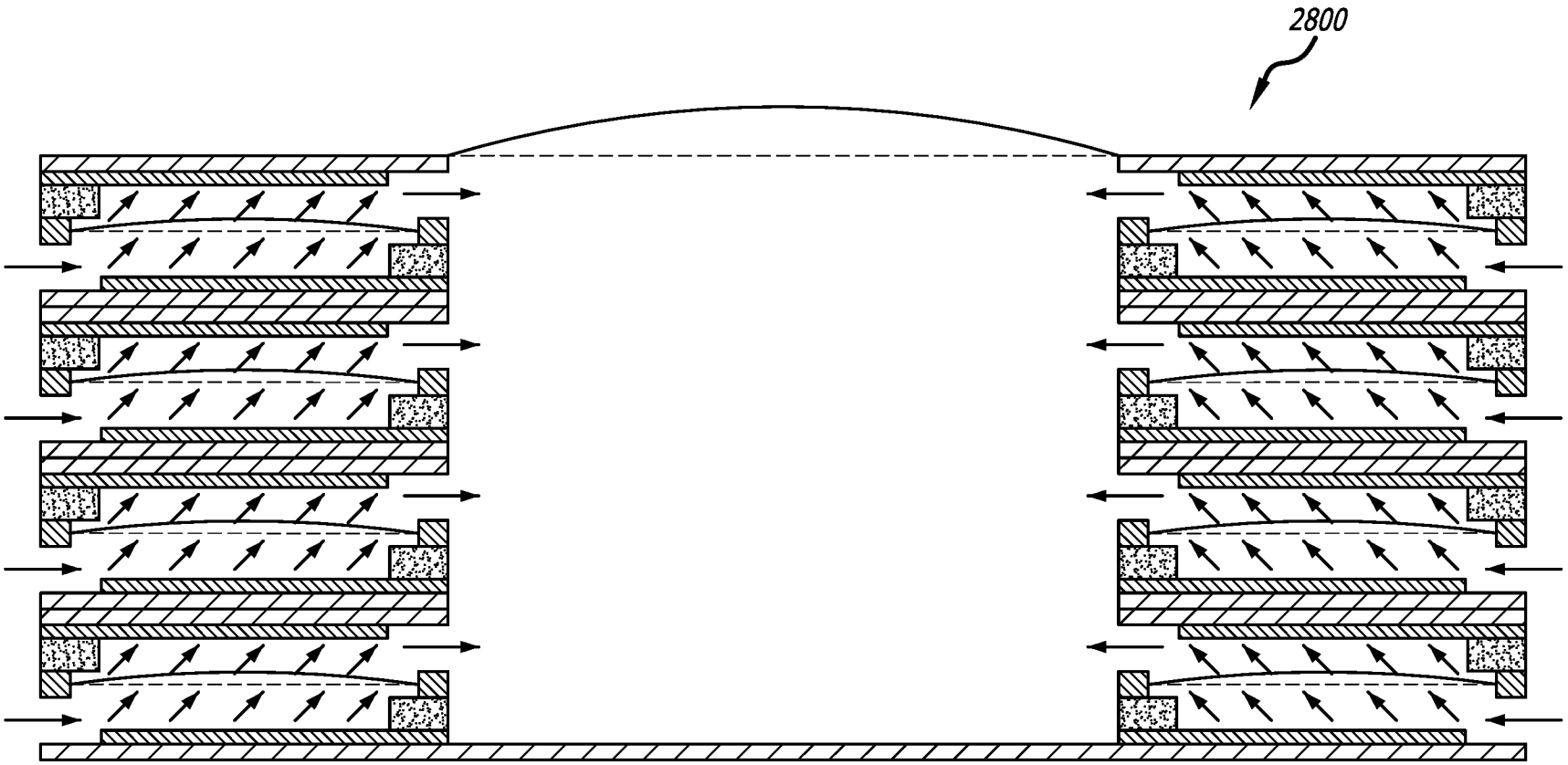
FIG. 2 (which is reproduced from the Pinkerton '353 patent) depicts an electrically conductive membrane pump/transducer that has a stacked array of electrically conductive membrane pumps.
Figure 3:
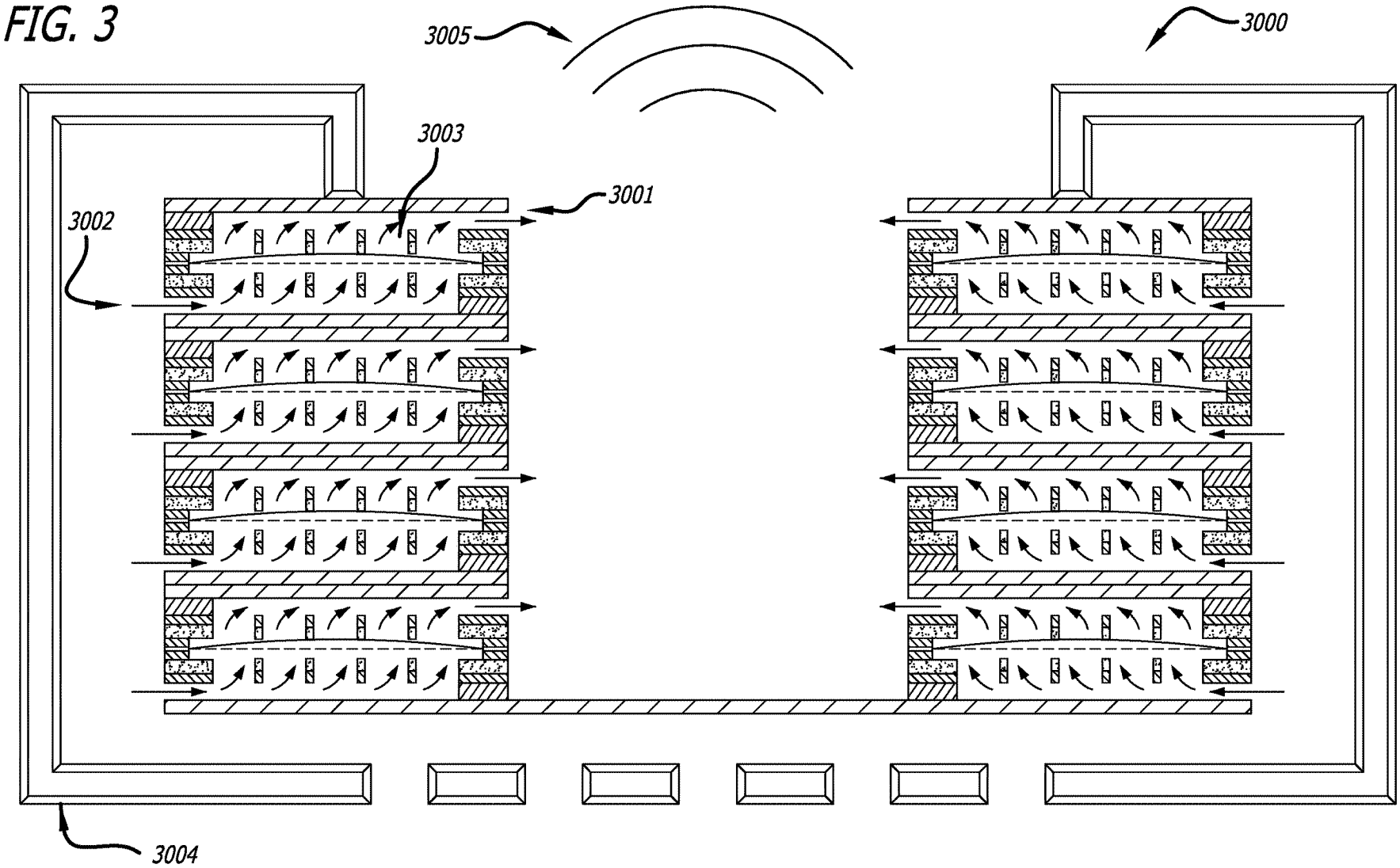
FIG. 3 (which is reproduced from the Pinkerton '353 patent) depicts an electrically conductive membrane pump/transducer that utilizes an array of electrically conductive membrane pumps that operates without a membrane or piston.
Figure 4:
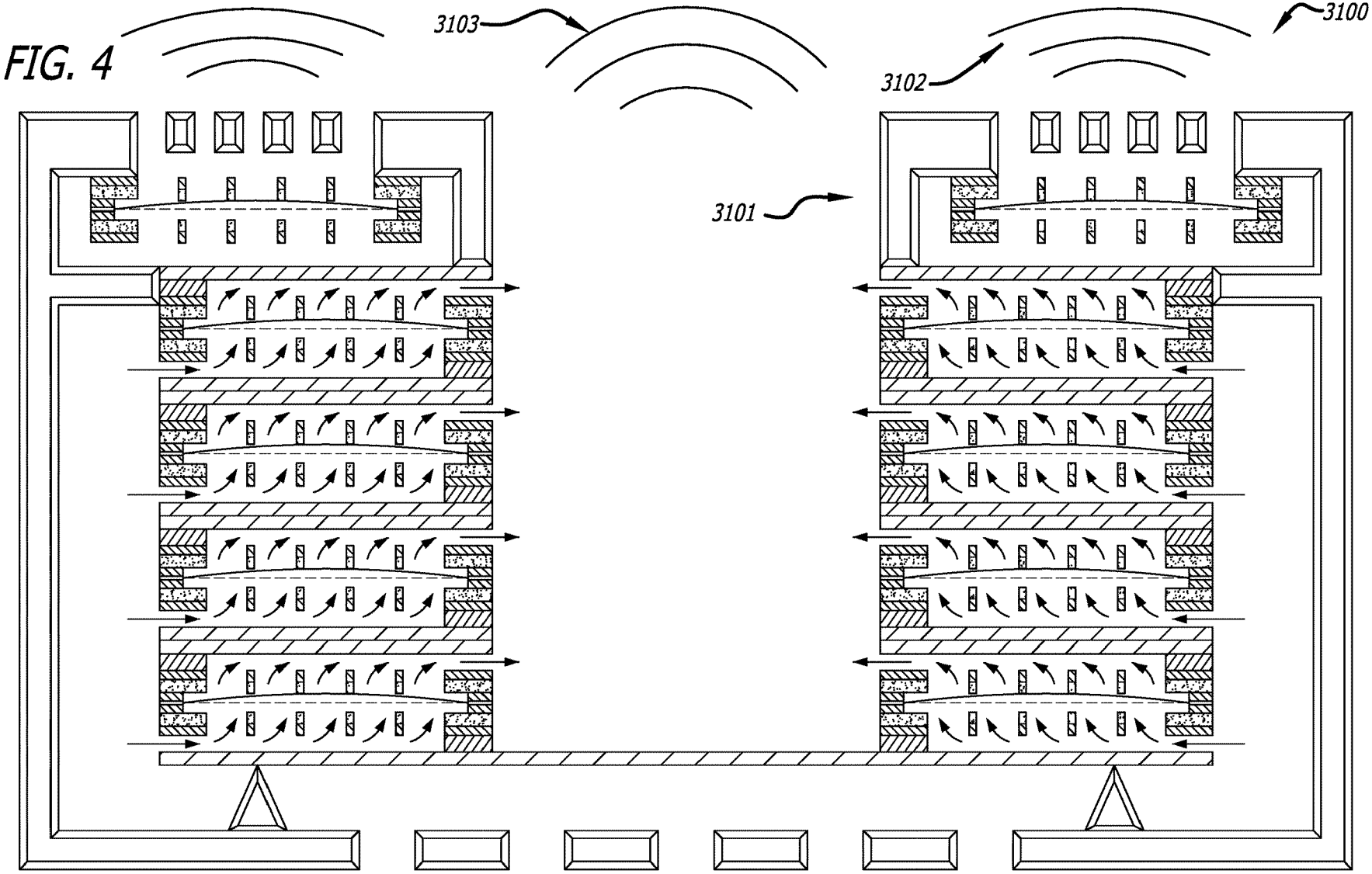
FIG. 4 (which is reproduced from the Pinkerton '353 patent) depicts an electrically conductive membrane pump/transducer 3100 that utilizes an array of electrically conductive membrane pumps and that also includes an electrostatic speaker.
Figure 5:
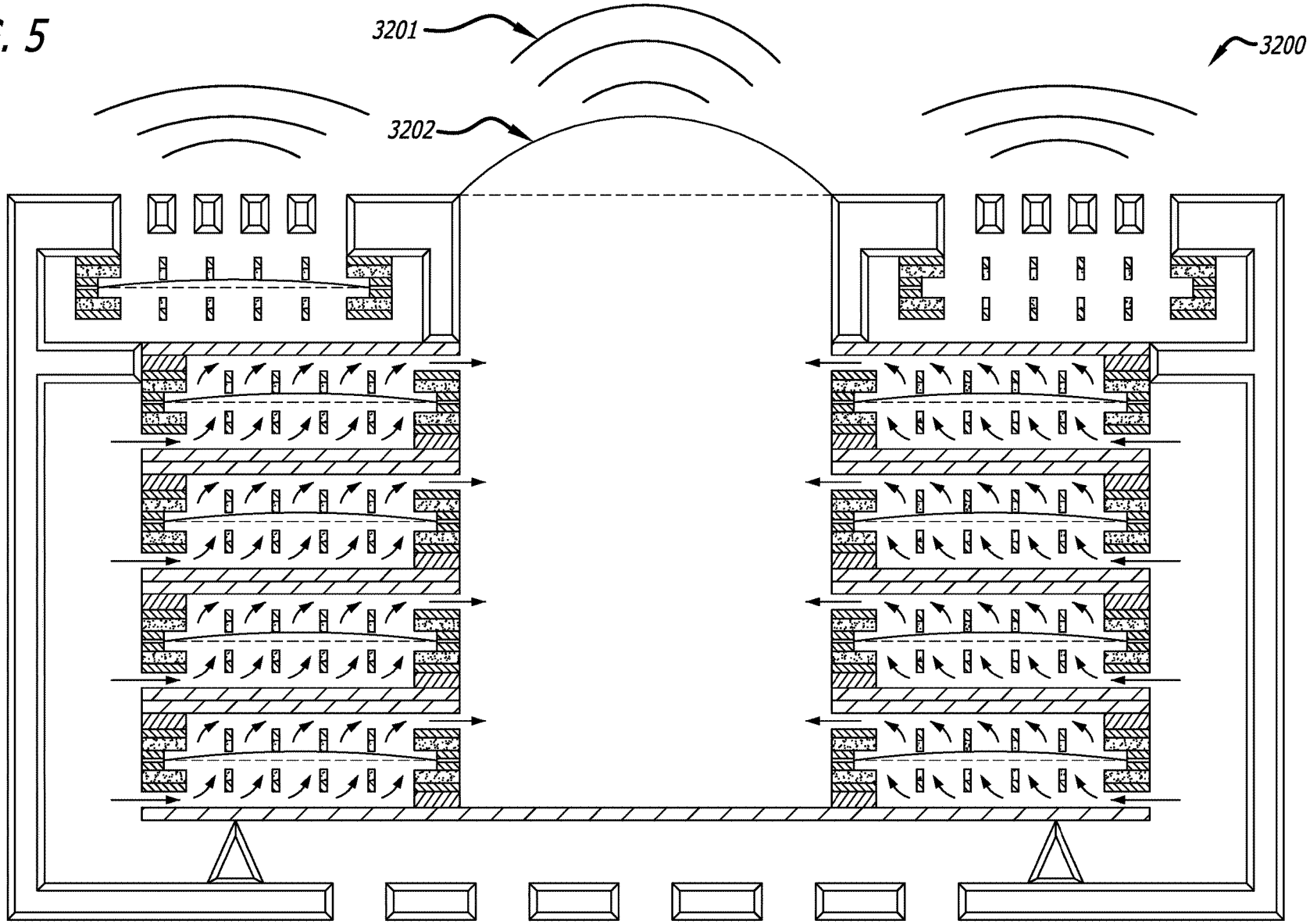
FIG. 5 (which is reproduced from the Pinkerton '353 patent) depicts an electrically conductive membrane pump/transducer 3200 that utilizes an array of electrically conductive membrane pumps that cause a membrane to move in phase and that also includes an electrostatic speaker.
Figure 6A:
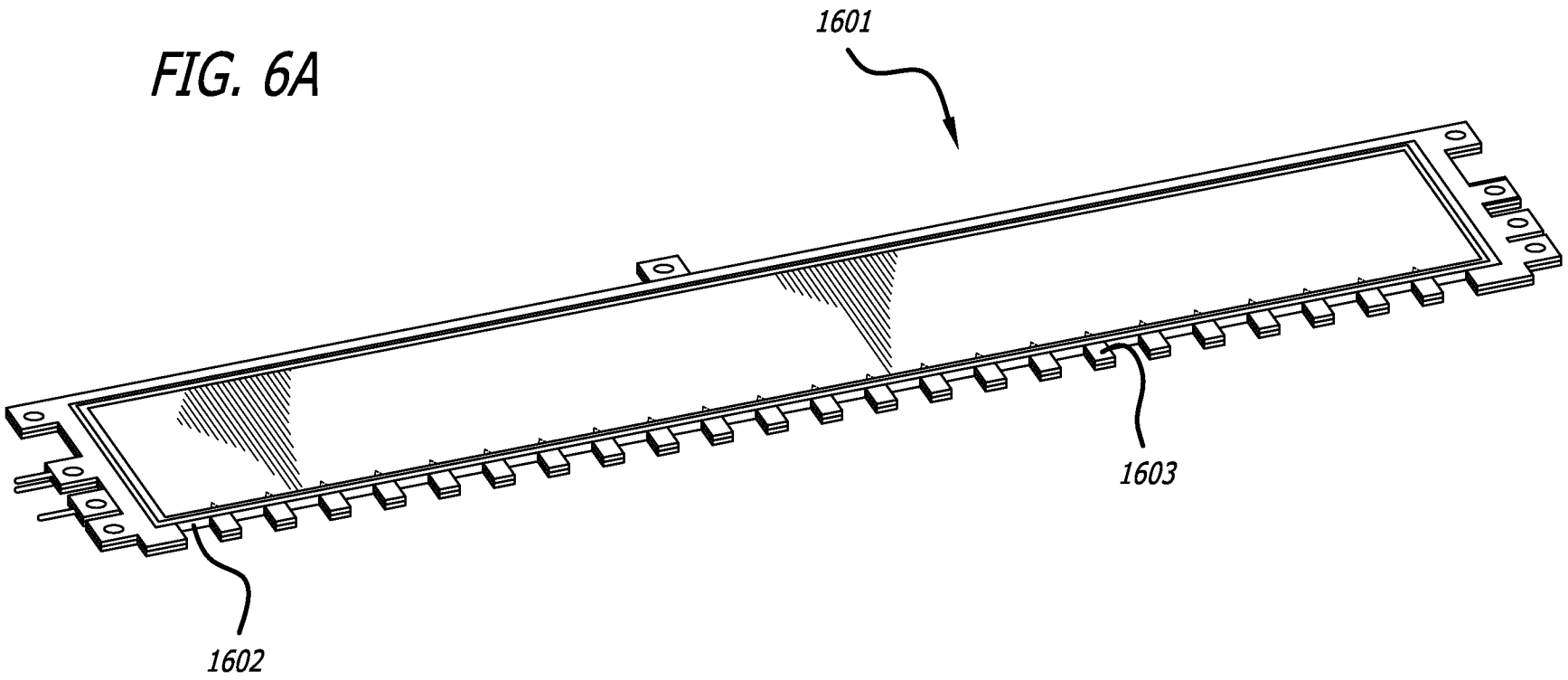
FIG. 6A (which is reproduced from the Pinkerton '313 patent) illustrates an electroacoustic transducer ("ET," which is also referred to as a "pump card") and its solid stator.
Figure 6B:
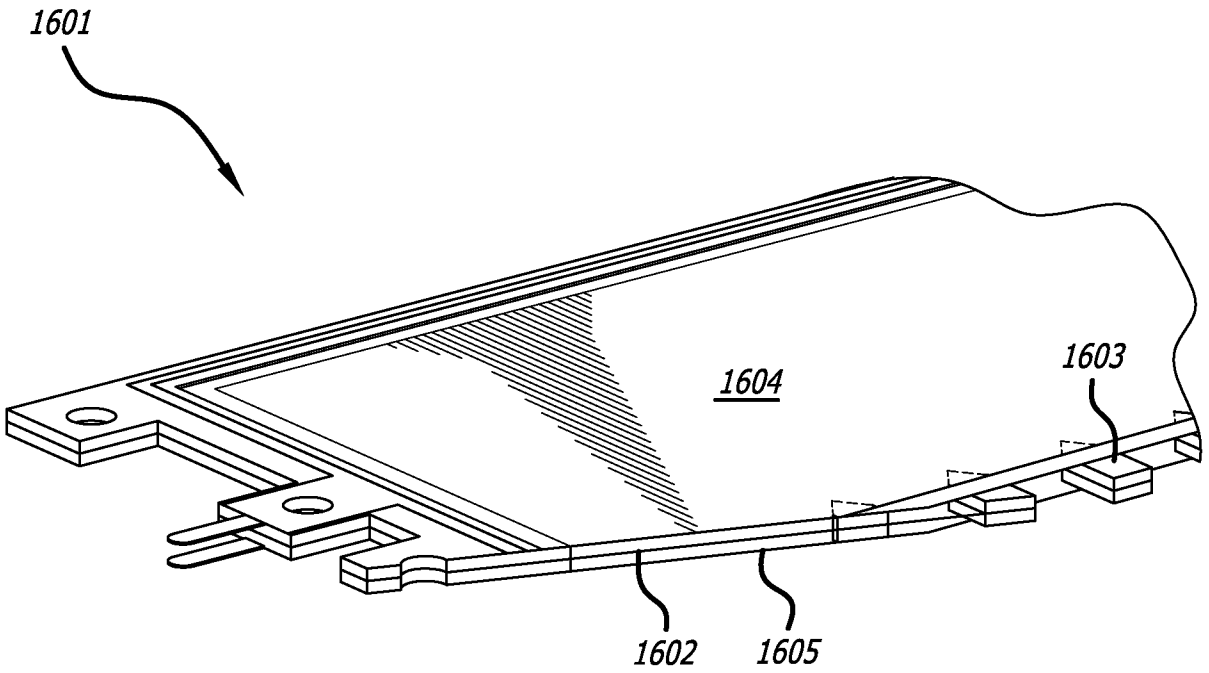
FIG. 6B (which is reproduced from the Pinkerton '313 patent) is a magnified view of the electroacoustic transducer of FIG. 6A.
Figure 6C:
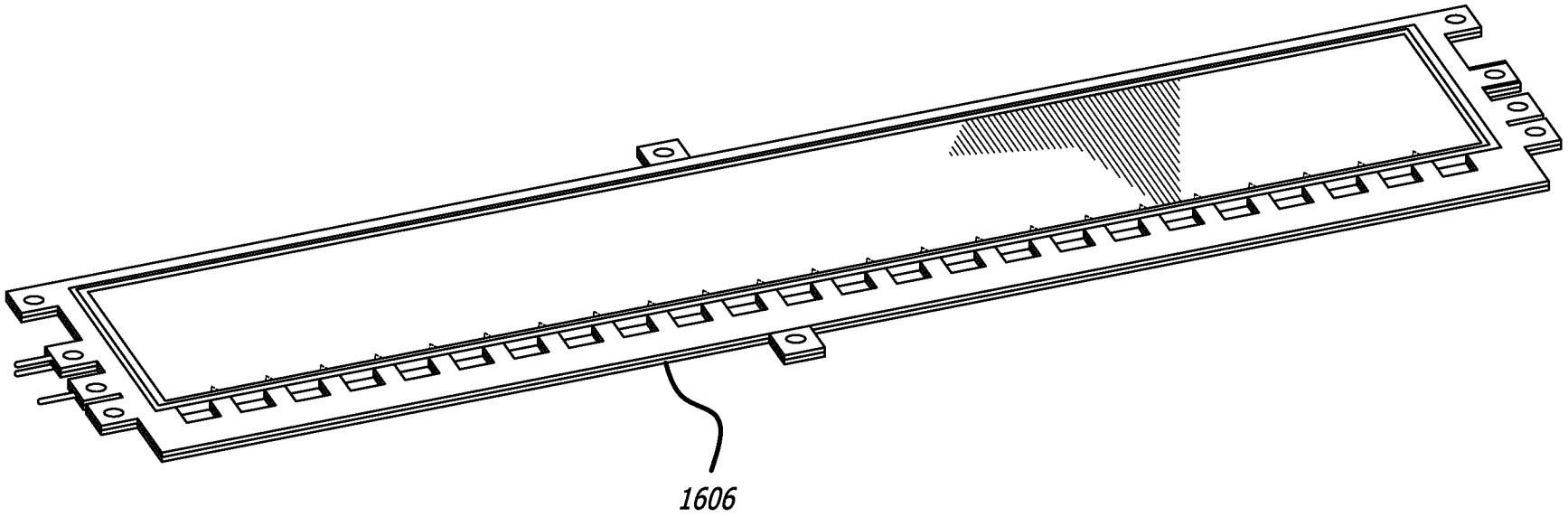
FIG. 6C (which is reproduced from the Pinkerton '313 patent) illustrates the electroacoustic transducer of FIG. 6A having a single stator card before trimming off the vent fingers.
Figure 7:
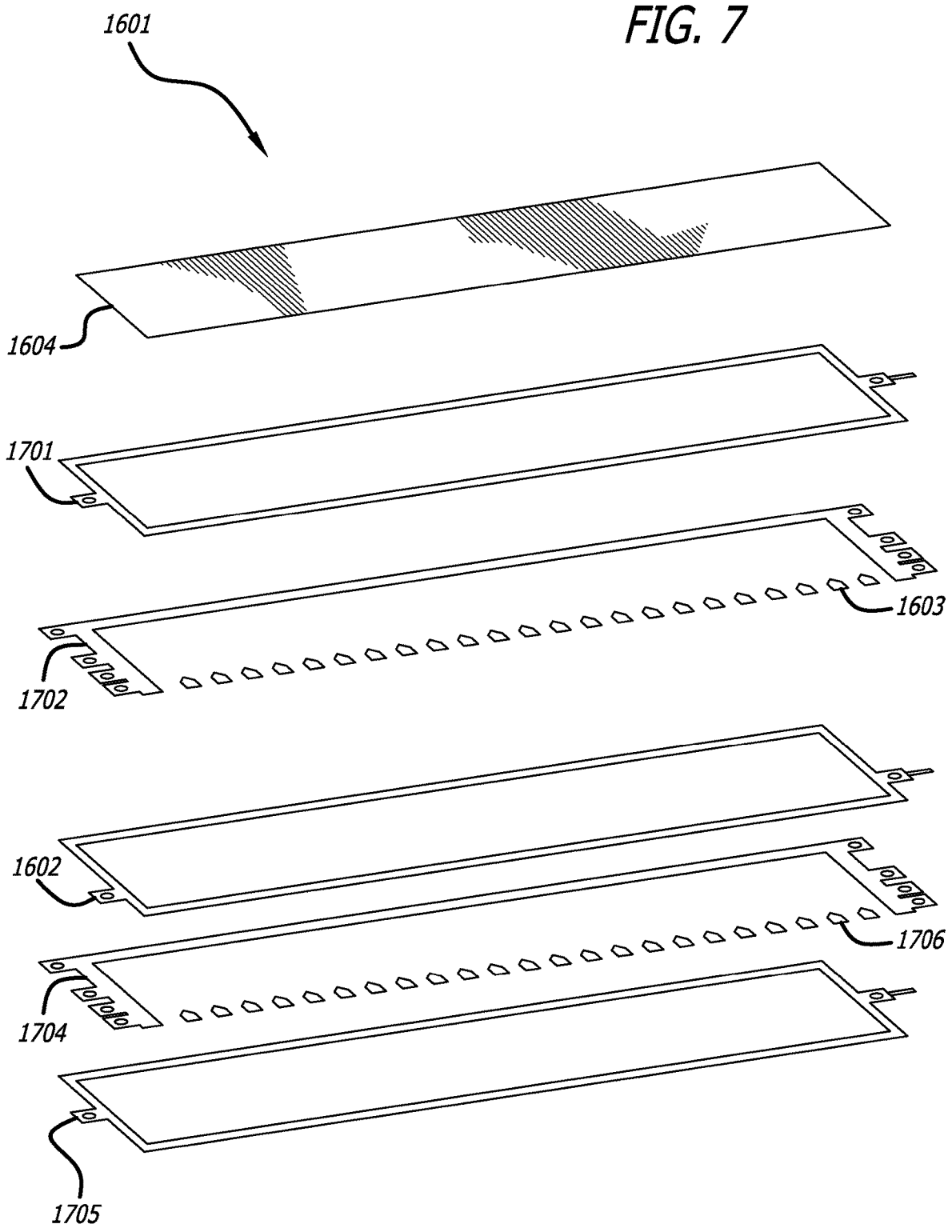
FIG. 7 (which is reproduced from the Pinkerton '313 patent) is exploded view of the electroacoustic transducer of FIG. 6A.
Figure 8A:
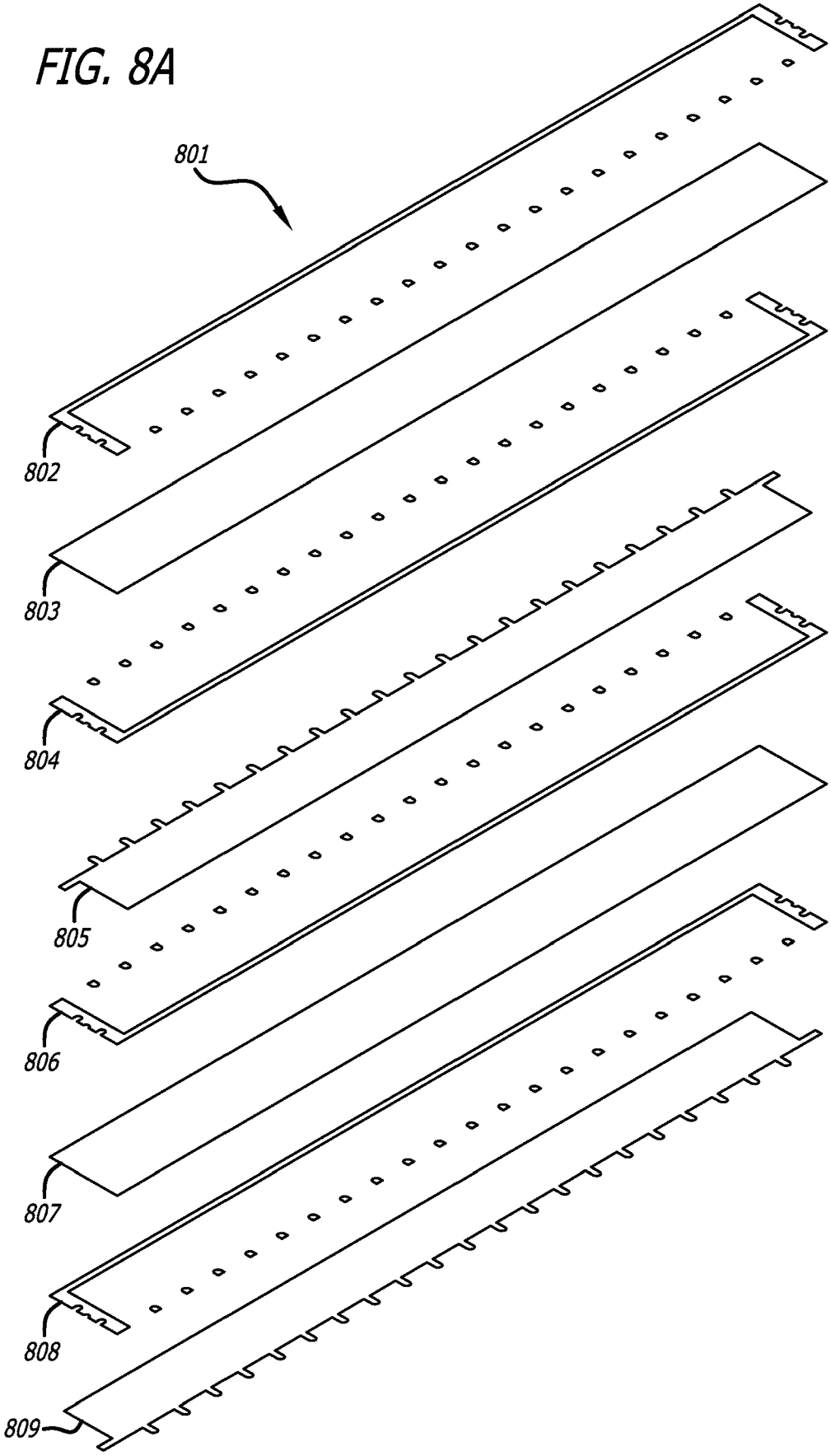
FIG. 8A (which is reproduced from the Badger '088 PCT application) illustrates an exploded view of an electroacoustic transducer.
Figure 8B:
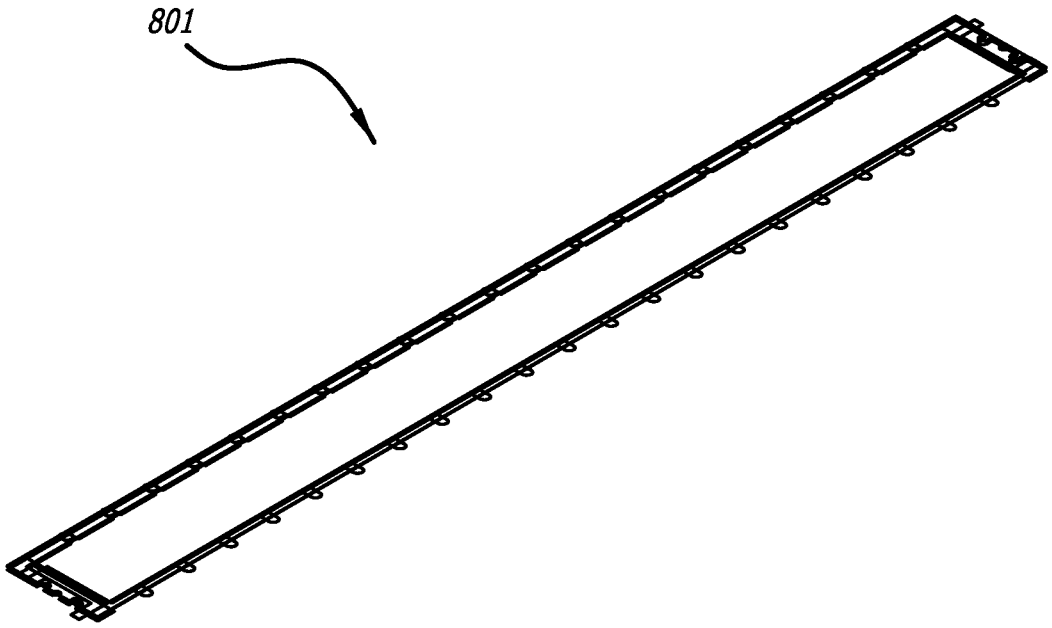
FIG. 8B (which is reproduced from the Badger '088 PCT application) illustrates the electroacoustic transducer shown in FIG. 8A in fabricated form.
Figure 9A:
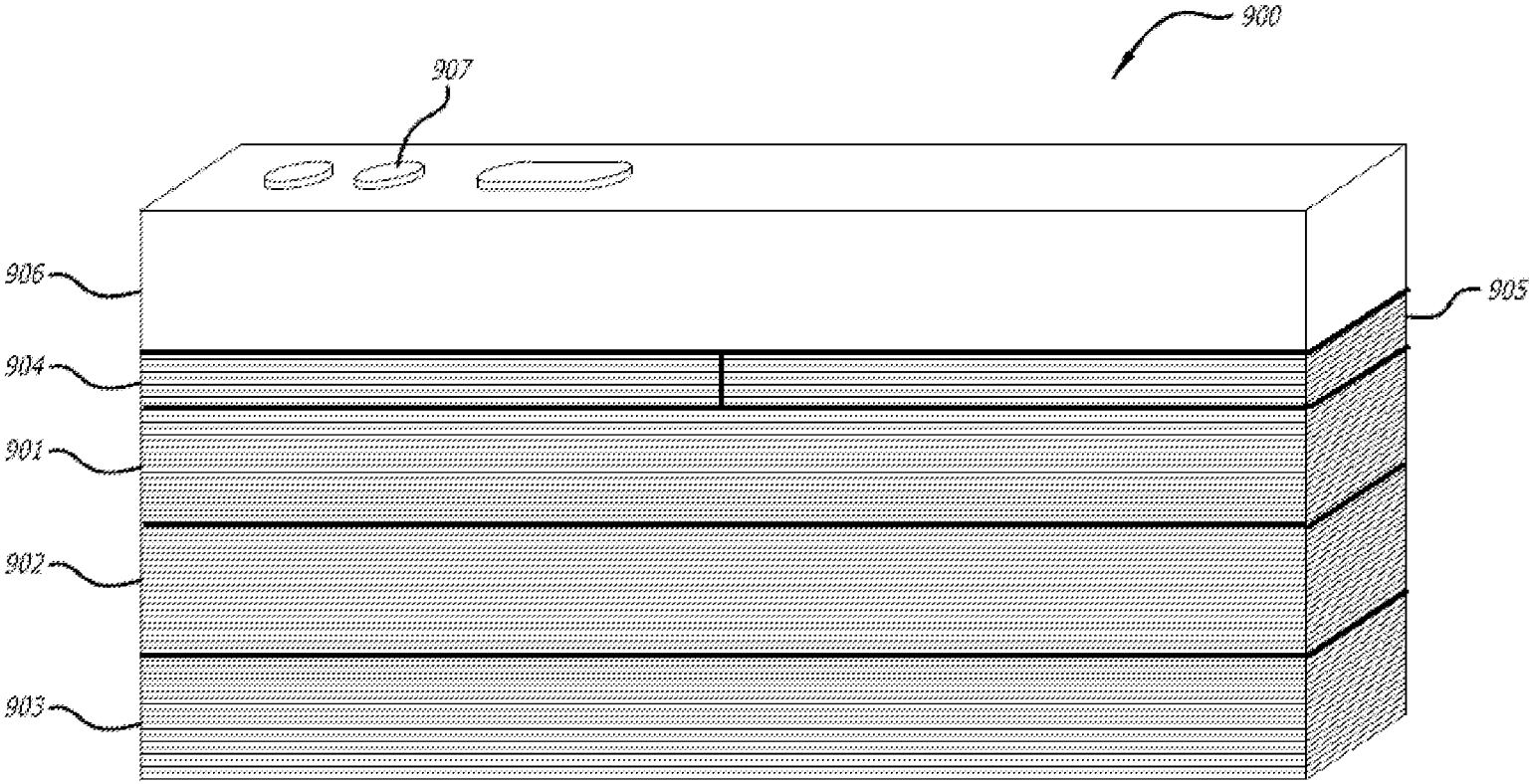
FIGS. 9A-9B (which are reproduced from the Pinkerton '073 application) illustrate a loudspeaker with stacked arrays of electrostatic venturi membrane-based pump/transducer (EVMP) cards.
Figure 9B:
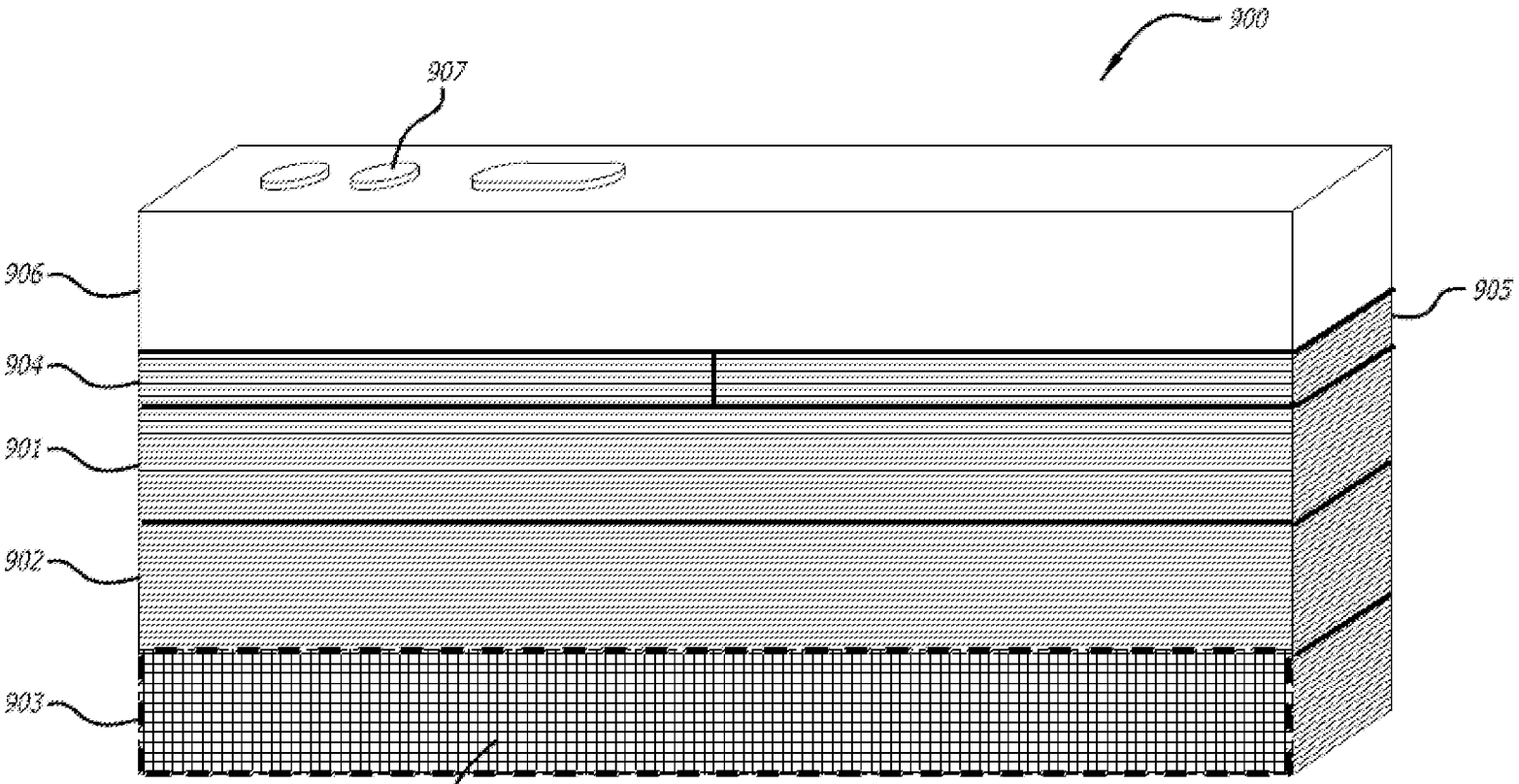
Figure 10:
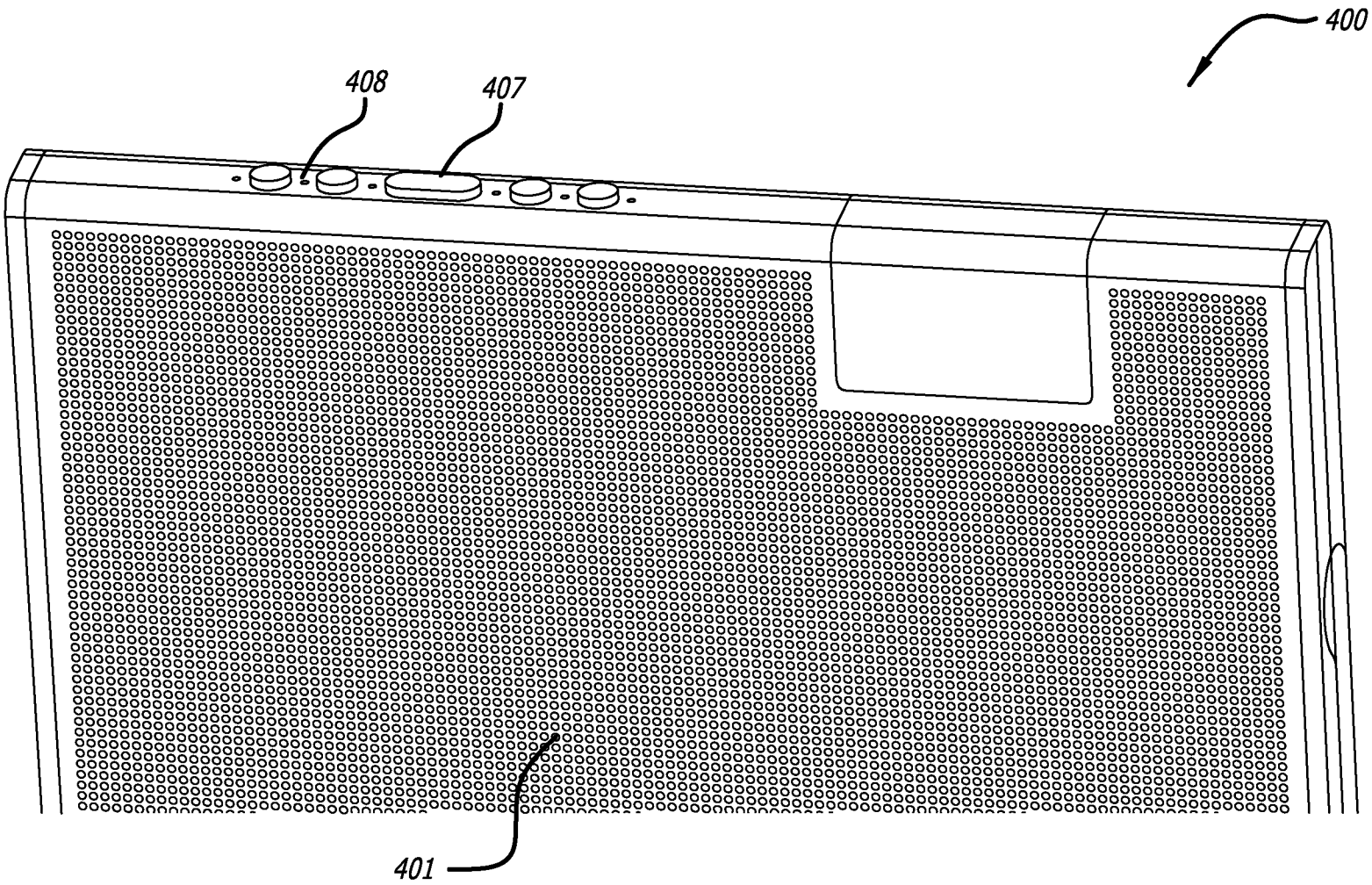
FIG. 10 (which is reproduced from the Pinkerton '438 PCT application) illustrates a dipole loudspeaker having electrostatic transducers.
Figure 11A:
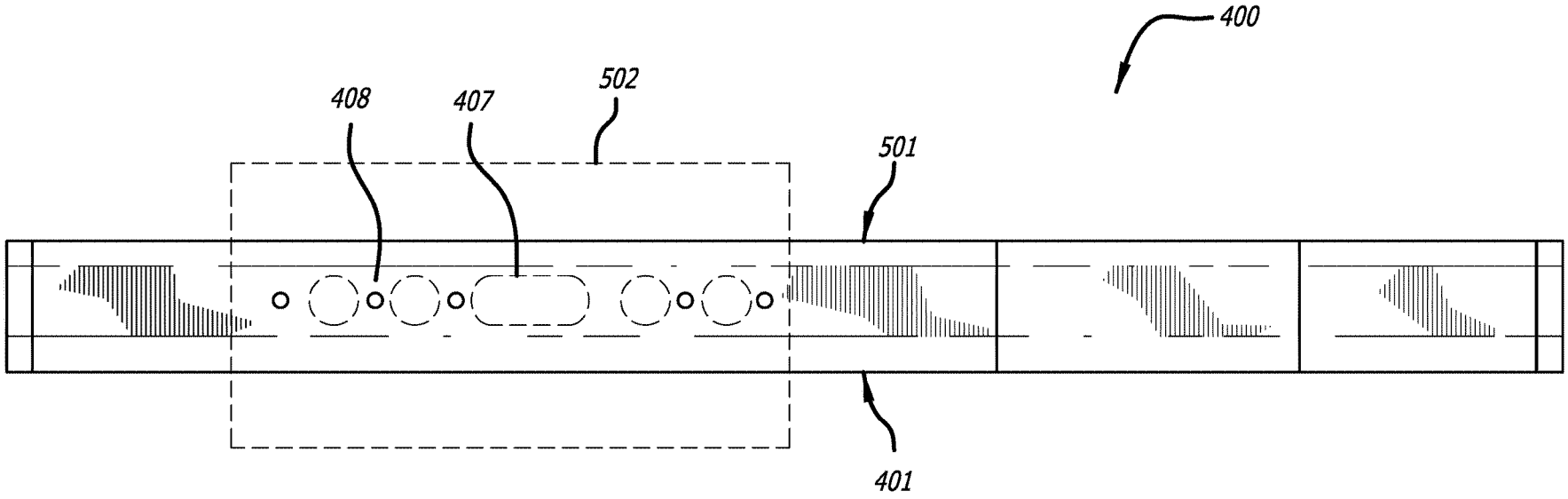
FIGS. 11A-11B (which are reproduced from the Pinkerton '438 PCT application) illustrate the null sound plane (NSP) of the speaker of FIG. 10.
Figure 11B:
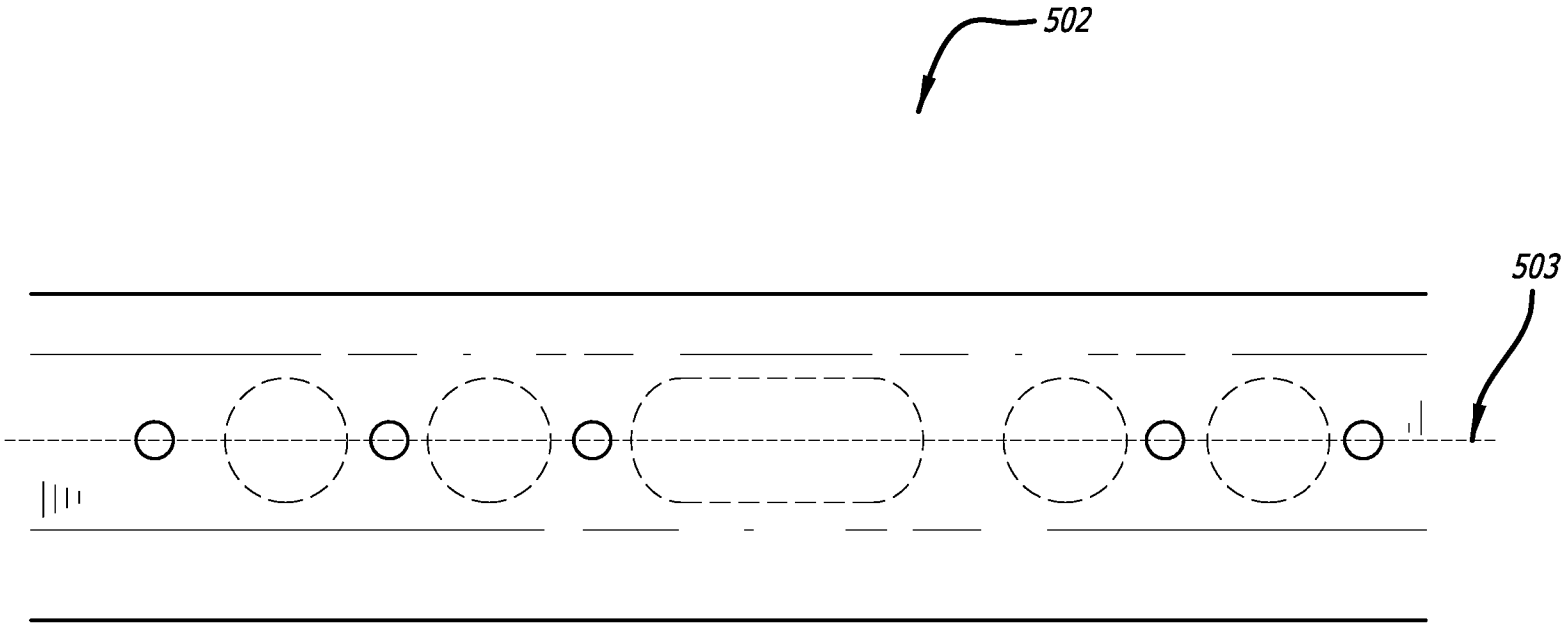
Figure 12A:
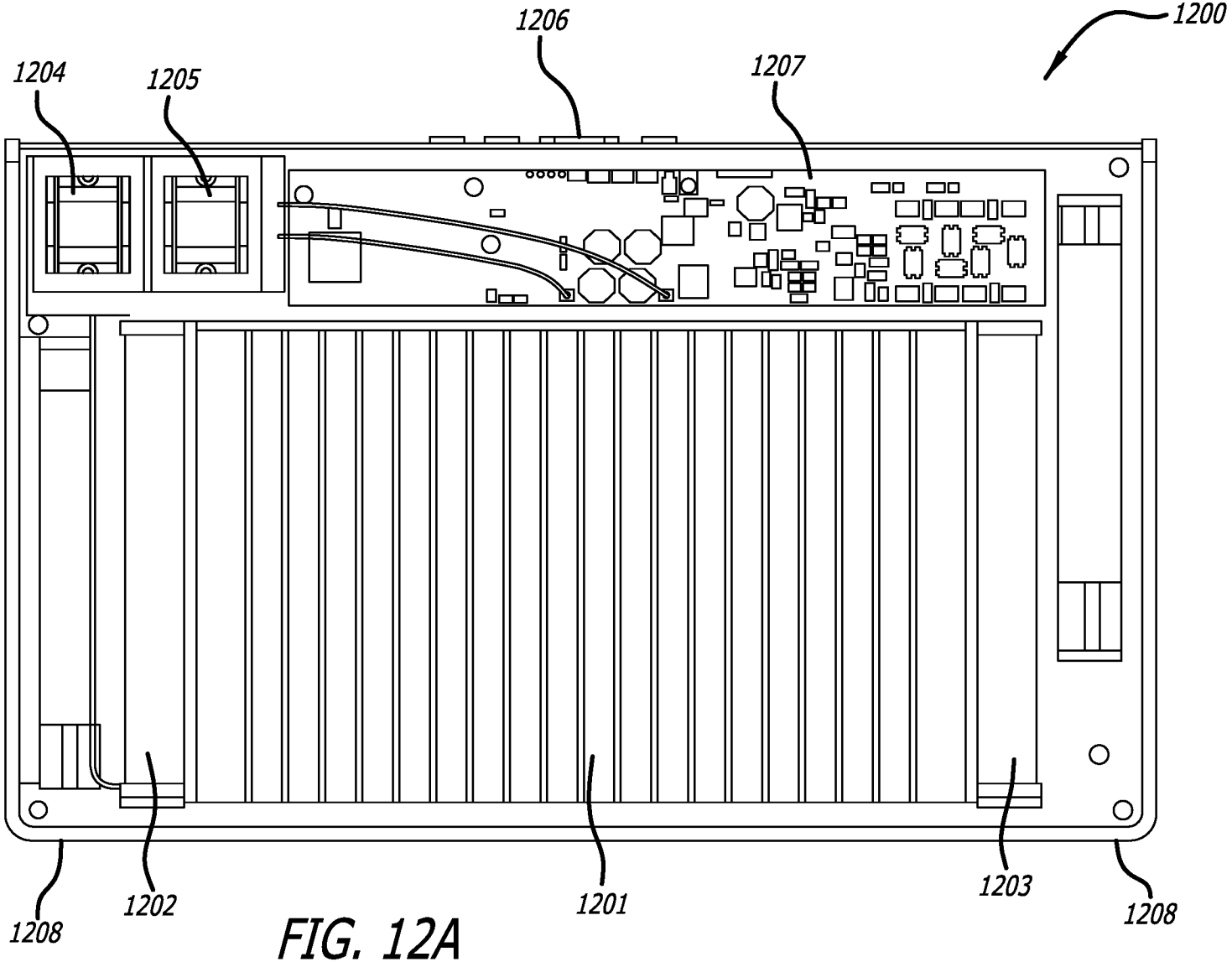
FIG. 12A is an illustration of an embodiment of the present invention.

As shown in FIG. 12A, loudspeaker system 1200 includes at least three card stacks 1201-1203. Card stack 1201 is the middle between card stack 1202 and card stack 1203. Card stack 1201 (which optionally can be a plurality of card stacks) contains the wider cards, as compared to the card stacks 1202 and 1203 (each of which optionally can be a plurality of card stacks). The "card width" is the span of the membrane of a card in the card stack. For example, the card width of card stack 1201 can be 21 mm (which 21 mm card width is the span of the membrane of the cards in card stack 1201), such as described and taught in the Pinkerton '669 application and the card width of each of the card stacks 1202-1203 can be 12 mm (which, 12 mm card width is the span of the membrane of the cards in card stacks 1202-1203). Generally, the card width of each of the card stacks 1202-1203 is the same.

Figure 12B:
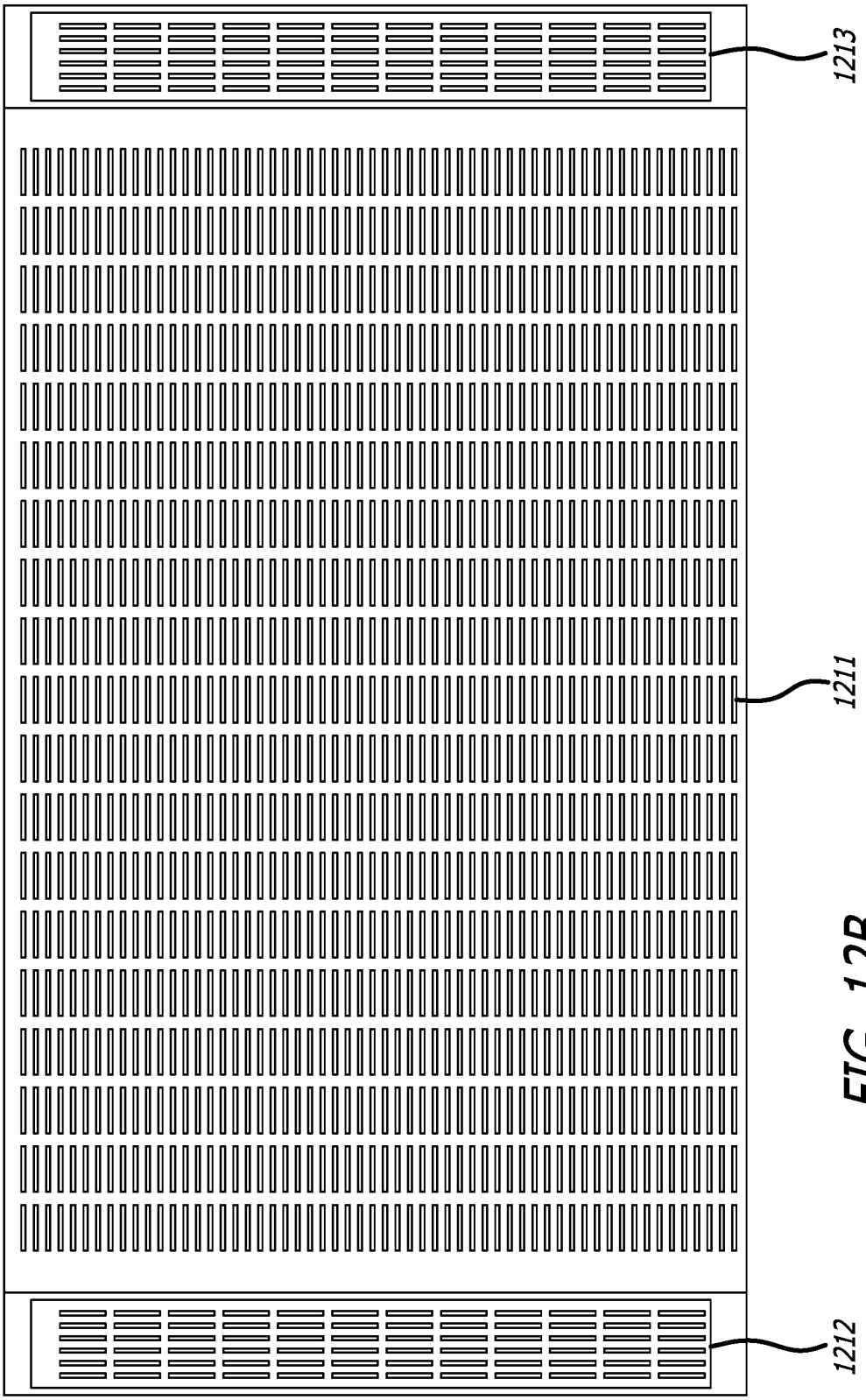
FIG. 12B is a photograph of three card stacks that are similar to the card stacks illustrated in FIG. 12A (including widths and orientation).

As shown in FIG. 12A, each of the card stacks 1202-1203 has been rotated 90°, as compared to card stack 1201. I.e., per the orientation of FIG. 12A, the cards in the card stack 1201 run horizontally (and such cards are stacked vertically), while the cards in each of the card stacks 1202-1203 run vertically (and such cards are stacked horizontally). FIG. 12B is a photograph of a wider card stack 1211 and two narrower card stacks 1212-1213 that are similar to the stacks described above (including widths and orientation) for card stacks 1201-1203, respectively, of loudspeaker system 1200.

In other embodiments the cards in each of the card stacks 1201-1203 can be in the same plane. For example, all of the card stacks can be horizontal, with narrower width card stacks on the top and bottom of a middle wider width card stack. Loudspeaker system 1200 has two transformers 1204-1205, which power card stacks 1202-1203, respectively. A high voltage inverter (on motherboard 1207) powers the card stack 1201, with one channel of an off-the-shelf inverter routed through transformer 1204 to power card stack 1202 and a second channel of the same off-the-shelf inverter routed through the transformer 1205 to power card stack 1203.

Additionally, loudspeaker system 1200 has control buttons 1206 and speaker feet 1208.

For definitional purposes, the two-audio track recordings will be referred to herein as having a "first track" (abbreviated "$T_1$") and a "second track (abbreviated "$T_2$").

Moreover, the frequency ranges of (a) card stack 1201 and (b) card stacks 1202-1203 will be different. Card stack 1201 is directed to lower frequency ranges (such as a changeover set point of 300 Hz and below). Card stacks 1202-1203 will each be directed to higher frequency ranges (such as a changeover set point of 300 Hz and above). Even though the changeover set points can be the same (such as at 300 Hz), card stacks 1201-1203 will have some crossover. For example, for card stack 1201, it will have an upper set point (such as 1000 Hz) in which card stack 1201 emits 0% sound above this upper set point and 100% sound at the changeover set point (such as the 300 Hz changeover set point), with a transition (such as a linear transition between the upper set point and the changeover set point). Similarly, for example, for card stacks 1202-1203, each will have a lower set point (such as 200 Hz) in which card stack emits 0% sound below this lower set point and 100% at the changeover set point (such as the 300 Hz changeover set point), with a transition (such as a linear transition between the lower set point and the changeover set point). Controls for such crossovers are known in the art.

With respect to the first track and the second track of the two-audio track recordings, each of the card stacks 1201-1203 emits sound (in their respective frequency ranges) based upon a combination of these two tracks.

For card stack 1201, the first and second tracks generally are averaged. The formula for this is:

$$(T_1+T_2)/2 \quad (1)$$

In alternative embodiments, the first and second tracks can be a weighted average, which optionally can be controlled.

For card stack 1202, the modified track for card stack 1202 will be the first track (typically with some increase in intensity) additionally modified by some elimination (subtraction) of the second track. A formula for this is:

$$(1+x)T_1-(y)T_2 \quad (2)$$

For card stack 1203, the modified track for card stack 1203 will be the second track (typically with some increase in intensity) additionally modified by some elimination (subtraction) of the first track. A formula for this is:

$$(1+x)T_2-(y)T_1 \quad (3)$$

For both equations (2) and (3), the values of x and y can be, respectively, $0 \le x \le 1.5$ and $0 \le y \le 1.5$. Typically, the values of x and y in this range (such as between 0 and 1.5, inclusive) are approximately the same, which has the effect of normalizing loudness of the resulting modified tracks for each of card stacks 1202-1203. In some embodiments, the values of x and y are both at 0.75. In some embodiments, each of x and y is in the range between 0.25 and 1.25, and, in further embodiments, each of x and y is in the range between of 0.5 and 1.

Figure 13:
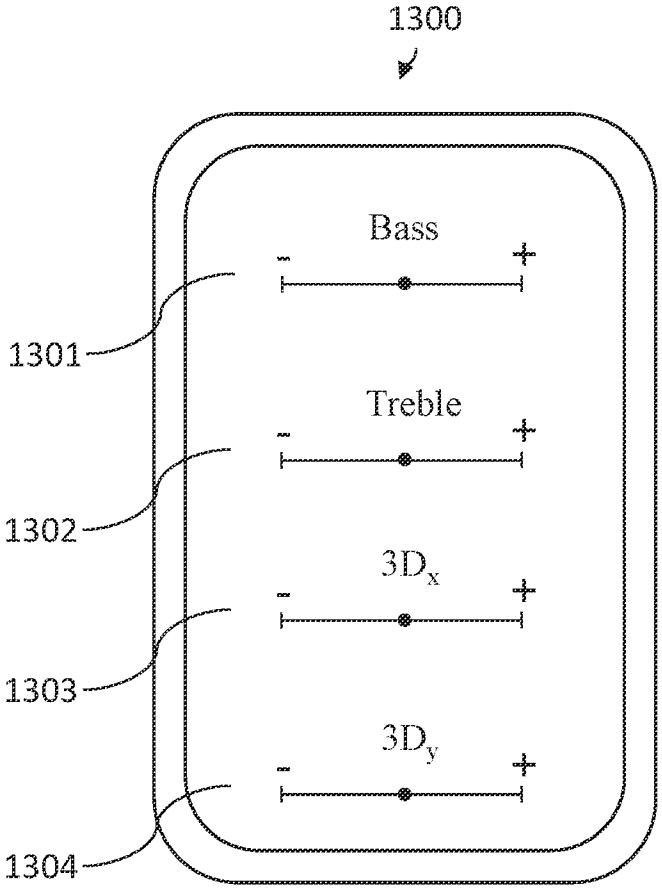
FIG. 13 is an illustration of a controller that includes the ability to control independently the increase of intensity of one channel and some elimination (subtraction) of the other channel of two audio-track recordings.

Since x and y can be varied independently of one another (such as between 0 and 1.5, inclusive), a controller, such as controller 1300 shown in FIG. 13, can be used to control independently x and y in equations (2) and (3). As shown in FIG. 13, in addition to controls for bass 1301 and treble 1302, the controller has controls for x ("$3D_x$") 1303 and for y ("$3D_y$") 1304. The midpoint of controls 1303-1304 can be set at some pre-determined amounts, such as 0.75 for both x and y.

In alternative embodiments, x and y can be dependent upon one another, such as x being equal to y (which again will generally normalize loudness for the modified tracks). In such event equations (2) and (3) will be, respectively, equations (2)* and (3)*.

$$T_1+x(T_1-T_2) \quad (2)^*$$

$$T_2+x(T_2-T_1) \quad (3)^*$$

Again, x can be between 0 and 1.5, inclusive. In some embodiments, x is in the range between 0.25 and 1.25, and, in further embodiments, x is in the range between of 0.5 and 1.

Figure 14:
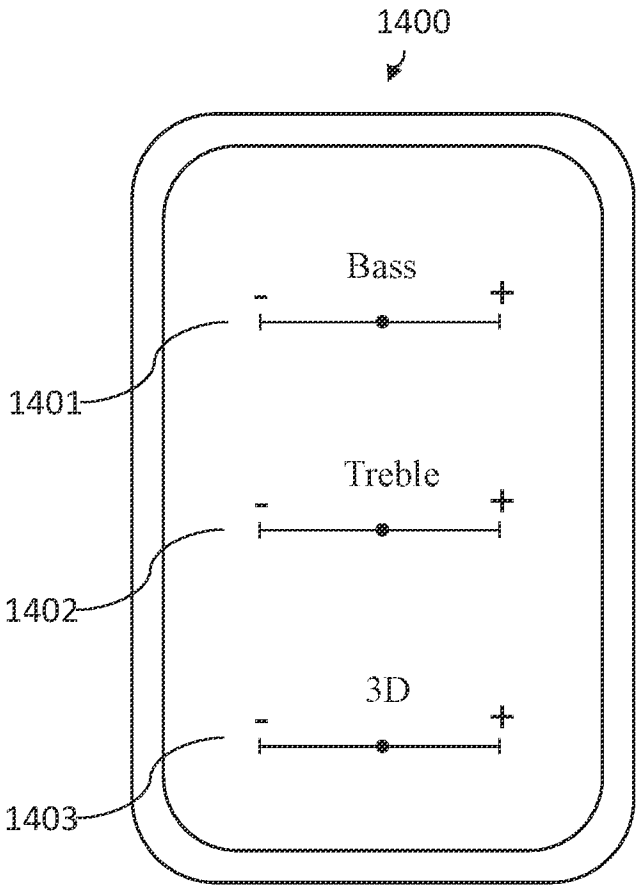
FIG. 14 is an illustration of a controller that includes the ability to control together the increase of intensity of one channel and some elimination (subtraction) of the other channel of two audio-track recordings.

For these embodiments, a controller, such as controller 1400 shown in FIG. 14, can be used to control x in equations (2)* and (3)*. As shown in FIG. 14, in addition to controls for bass 1401 and treble 1402, the controller has controls for x ("3D") 1403. The midpoint of controls 1403 can be set at some pre-determined amount, such as 0.75 for x.

The loudspeaker systems of the present invention produced an audio quality that was surprisingly advanced over prior art loudspeaker systems. Such configurations achieved further stereo separation and an increase in audio quality, which can be described as 3D audio. The sound emitted was as if instruments and voices were spread out around the room even though the speakers in the speaker system were all in the same device (which was small and portable). Without being bound by theory, it is believe that this effect is due to the unique combination of utilizing electrostatic card stacks (which tend to beam sound like a flashlight beams light) and the use of the modified first and second tracks in each of the various card stacks. Regardless of the theory, the resulting sound from the loudspeaker systems of the present invention is quite striking.

For the tweeter card stack on the first side (i.e., card stack 1202), it appears that subtracting the second channel signal from the first tweeter stack helps to cancel some of the second channel signal from the first near portion of the middle card stack driver (i.e., card stack 1201). (The "first nearer portion of the middle card stack driver" is the side of the middle card stack driver that is adjacent to the first tweeter stack; conversely, the "second nearer portion of the middle card stack driver" is the side of the middle card stack driver that is adjacent to the second tweeter stack"). This arrangement makes the first near portion of the middle card stack driver appear to produce more first channel signal than second channel signal. This, in part, is due to the crossover of frequencies of the middle card stack driver and the first tweeter stack.

For the tweeter card stack on the second side (i.e., card stack 1203), it appears that a similar process causes the second near portion of the middle card stack driver (i.e., card stack 1201) to produce more of the second channel signal. Again, this makes the second near portion of the middle card stack driver more like the second card stack than simply a mono middle card stack driver.

It is further believed that another characteristic of the electrostatic drivers that is likely helping to produce the 3D effect (and enhanced stereo separation) is that the motion of electrostatic membranes is in phase (generally always in phase) with the audio signal. Traditional electrodynamic cone drivers are known to often be out of phase with the audio signal due to electrical and mechanical resonances (and also due to the relatively high inertia of the moving copper coil). The fact that the small and larger drivers of the present invention are in phase (generally always) with the audio signal likely enhances the stereo separation and 3D effect. In other words, cone drivers produce audio waves that do not always add or subtract completely due to their phase differences, whereas electrostatic driver audio signals add/subtract completely and are thus better able to produce enhanced stereo/3D effects.

In an alternative embodiment, the middle card stack (card stack 1201) of loudspeaker system 1200 can be replaced with a conventional driver, and then utilized in a similar manner as discussed above. While the presence of the middle card stack 1201 enhances the 3D effects, the 3D effects still appears (primarily, but not to the same degree) due to the use of the two card stacks 1202-1203 with the convention driver (that is usually used for the bass frequencies). Testing has revealed that in this alternative embodiment, there remained some beneficial interaction between the conventional bass driver and the tweeter card stacks that accentuates both stereo separation and the 3D effect.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. The scope of protection is not limited by the description set out above, but is only limited by the claims which follow, that scope including all equivalents of the subject matter of the claims.

The disclosures of all patents, patent applications, and publications cited herein are hereby incorporated herein by reference in their entirety, to the extent that they provide exemplary, procedural, or other details supplementary to those set forth herein.

Amounts and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of approximately 1 to approximately 4.5 should be interpreted to include not only the explicitly recited limits of 1 to approximately 4.5, but also to include individual numerals such as 2, 3, 4, and sub-ranges such as 1 to 3, 2 to 4, etc. The same principle applies to ranges reciting only one numerical value, such as "less than approximately 4.5," which should be interpreted to include all of the above-recited values and ranges. Further, such an interpretation should apply regardless of the breadth of the range or the characteristic being described.

Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are now described.

Following long-standing patent law convention, the terms "a" and "an" mean "one or more" when used in this application, including the claims.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that can vary depending upon the desired properties sought to be obtained by the presently disclosed subject matter.

As used herein, the term "about" and "substantially" when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, the term "substantially perpendicular" and "substantially parallel" is meant to encompass variations of in some embodiments within ±10° of the perpendicular and parallel directions, respectively, in some embodiments within ±5° of the perpendicular and parallel directions, respectively, in some embodiments within ±1° of the perpendicular and parallel directions, respectively, and in some embodiments within ±0.5° of the perpendicular and parallel directions, respectively.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

What is claimed is:

1. A loudspeaker system comprising:

(a) a middle speaker operable for emitting audible sound in a first range between 20 Hz and an upper set point frequency;

(b) a first end speaker comprising a plurality of a first stack of cards having electrostatic transducers, wherein (i) the first end speaker is attached at or near a first end of the middle speaker, and (ii) the first end speaker is operable for emitting audible sound in a second range between a lower set point frequency and 20 kHz; and (c) a second end speaker comprising a plurality of a second stack of cards having electrostatic transducers, wherein (i) the second end speaker is attached at or near a second end of the middle speaker such that the middle speaker is between the first speaker and the second speaker, (ii) the second end speaker is operable for emitting audible sound in the second range between the lower set point frequency and 20 kHz, and (iii) the loudspeaker system is operable to emit sound based upon an audio track recording comprising a first track ($T_1$) and a second track ($T_2$), wherein (A) the middle speaker is operable to emit sound based upon a weighted average of the first track ($T_1$) and the second track ($T_2$), (B) the first end speaker is operable to emit sound based upon the first track ($T_1$) modified by at least some subtraction of the second track ($T_2$) utilizing a second formula $(1+x)T_1-(y)T_2$, (C) the second end speaker is operable to emit sound based upon the second track ($T_2$) modified by at least some subtraction of the first track ($T_1$) utilizing a third formula $(1+x)T_2-(y)T_1$, and (D) each of x and y is in a range between 0 and 1.5 for the second formula and the third formula.

2. The loudspeaker system of claim 1, wherein
(a) the upper set point frequency is at most 1000 Hz; and
(b) the lower set point frequency is at least 200 Hz.

3. The loudspeaker system of claim 1, wherein the first stack of cards has a stack card width that is the same as the second stack of cards.

4. The loudspeaker system of claim 1, wherein the middle speaker comprises a plurality of a third stack of cards having electrostatic transducers.

5. The loudspeaker system of claim 1 further comprising:
(a) a first transformer to power the first stack of cards in the first end speaker; and
(b) a second transformer to power the second stack of cards in the second end speaker.

6. The loudspeaker system of claim 5 further comprising a motherboard having a voltage inverter, wherein
(a) the voltage inverter has a first channel through which power can be routed through the first transformer to power the first stack of cards; and
(b) the voltage inverter has a second channel through which power can be routed through the second transformer to power the second stack of cards.

7. The loudspeaker system of claim 1, wherein the loudspeaker system has a changeover set point frequency.

8. The loudspeaker system of claim 7, wherein
(a) the upper set point frequency is greater than the changeover set point frequency; and
(b) the lower set point frequency is less than the changeover set point frequency.

9. The loudspeaker system of claim 8, wherein
(a) the middle speaker is operable for emitting audible sound at a decreasing volume percentage between the changeover set point frequency and the upper set point frequency, in which, at the changeover set point frequency, the volume percentage is 100% and, at the upper set point frequency, the volume percentage is 0%; and
(b) the first end speaker and the second end speaker are each operable for emitting audible sound at an increasing volume percentage between the lower set point frequency and the changeover set point frequency, in which, at the lower set point frequency, the volume percentage is 0% and, at the changeover set point frequency, the volume percentage is 100%.

10. The loudspeaker speaker of claim 1, wherein the loudspeaker system is operable to vary x and y independently.

11. The loudspeaker system of claim 1 further comprising a controller that is operable to vary x and y independently.

12. The loudspeaker speaker of claim 1, wherein x and y are dependent upon one another.

13. The loudspeaker system of claim 12 further comprising a controller that is operable to vary x.

14. The loudspeaker system of claim 13, wherein the controller is a hand held controller.

15. The loudspeaker system of claim 1, wherein the loudspeaker system has a null sound plane.

16. A method comprising:
(a) selecting an audio track recording comprising a first track ($T_1$) and a second track ($T_2$); and
(b) utilizing a loudspeaker system to emit audible sound based upon the audio track recording, wherein
(i) a middle speaker of the loudspeaker system is utilized to emit audible sound (I) in a first range between 20 Hz and an upper set point frequency and (II) based upon a weighted average of the first track ($T_1$) and the second track ($T_2$),
(ii) a first end speaker of the loudspeaker system is utilized to emit audible sound (I) in a second range between a lower set point frequency and 20 kHz, and (II) based upon the first track ($T_1$) modified by at least some subtraction of the second track ($T_2$) utilizing a second formula $(1+x)T_1-(y)T_2$, wherein
(A) the first end speaker comprises a plurality of a first stack of cards having electrostatic transducers, and
(B) the first end speaker is attached at or near a first end of the middle speaker; and
(iii) a second end speaker of the loudspeaker system is utilized to emit audible sound (I) in the second range between the lower set point frequency and 20 kHz, and (II) based upon the second track ($T_2$) modified by at least some subtraction of the first track ($T_1$) utilizing a third formula $(1+x)T_2-(y)T_1$, wherein
(A) the second end speaker comprises a plurality of a second stack of cards having electrostatic transducers,
(B) the second end speaker is attached at or near a second end of the middle speaker such that the middle speaker is between the first speaker and the second speaker, and
(C) each of x and y is in a range between 0 and 1.5 for the second formula and the third formula.

17. The method of claim 16, wherein
(a) the upper set point frequency is at most 1000 Hz; and
(b) the lower set point frequency is at least 200 Hz.

18. The method of claim 16 further comprising:
(a) utilizing a first transformer to power the first stack of cards in the first end speaker; and
(b) utilizing a second transformer to power the second stack of cards in the second end speaker.

19. The method of claim 18, wherein
(a) the loudspeaker system further comprises a motherboard having a voltage inverter, and
(b) the method further comprises
(i) utilizing a first channel of the voltage inverter to route power through the first transformer to the first stack of cards, and
(ii) utilizing a second channel of the voltage inverter to route power through the second transformer to the second stack of cards.

20. The method of claim 16, wherein the loudspeaker system has a changeover set point frequency.

21. The method of claim 20, wherein
(a) the upper set point frequency is greater than the changeover set point frequency; and
(b) the lower set point frequency is less than the changeover set point frequency.

22. The method of claim 21, wherein
(a) the middle speaker is utilized to emit audible sound at a decreasing volume percentage between the changeover set point frequency and the upper set point frequency, in which, at the changeover set point frequency, the volume percentage is 100% and, at the upper set point frequency, the volume percentage is 0%; and
(b) each of the first end speaker and the second end speaker are utilized to emit audible sound at an increasing volume percentage between the lower set point frequency and the changeover set point frequency, in which, at the lower set point frequency, the volume percentage is 0% and, at the changeover set point frequency, the volume percentage is 100%.

23. The method of claim 16, wherein each of x and y is in a range between 0.25 and 1.25 for the second formula and the third formula.

24. The method of claim 16, wherein the method further comprises varying x and y independently.

25. The method of claim 16 further comprising utilizing a controller to vary x and y independently.

26. The method of claim 16, wherein x and y are dependent upon one another.

27. The method of claim 26 further comprising utilizing a controller to vary x.

28. The loudspeaker system of claim 11, wherein the controller is a hand held controller.

29. The loudspeaker system of claim 1, wherein each of x and y is in a range between 0.25 and 1.25 for the second formula and the third formula.

* * * * *